US008042606B2

(12) United States Patent
Batty et al.

(10) Patent No.: US 8,042,606 B2
(45) Date of Patent: Oct. 25, 2011

(54) MINIMAL-TEMPERATURE-DIFFERENTIAL, OMNI-DIRECTIONAL-REFLUX, HEAT EXCHANGER

(75) Inventors: J. Clair Batty, Logan, UT (US); Scott M. Jensen, Logan, UT (US)

(73) Assignee: Utah State University Research Foundation, North Logan, UT (US)

( * ) Notice: Subject to any disclaimer, the term of this patent is extended or adjusted under 35 U.S.C. 154(b) by 1210 days.

(21) Appl. No.: 11/743,555

(22) Filed: May 2, 2007

(65) Prior Publication Data

US 2010/0132923 A1 Jun. 3, 2010

Related U.S. Application Data

(60) Provisional application No. 60/861,583, filed on Nov. 29, 2006, provisional application No. 60/836,901, filed on Aug. 9, 2006.

(51) Int. Cl.
*F28D 15/04* (2006.01)

(52) U.S. Cl. ..... 165/104.26; 165/104.33

(58) Field of Classification Search ..... 165/80.4, 165/104.26, 104.33; 361/699, 700
See application file for complete search history.

(56) References Cited

U.S. PATENT DOCUMENTS

| | | | | |
|---|---|---|---|---|
| 3,613,778 | A | 10/1971 | Feldman | |
| 3,971,435 | A | 7/1976 | Peck | |
| 4,365,664 | A | 12/1982 | Basiulis | |
| 4,503,483 | A | 3/1985 | Basiulis | |
| 4,830,100 | A | 5/1989 | Kato et al. | |
| 4,880,052 | A | 11/1989 | Meyer, IV et al. | |
| 4,966,226 | A | 10/1990 | Hamburgen | |
| 5,308,920 | A * | 5/1994 | Itoh | 174/15.2 |
| 5,598,632 | A | 2/1997 | Camarda et al. | |
| 6,056,044 | A | 5/2000 | Benson et al. | |
| 6,101,715 | A * | 8/2000 | Fuesser et al. | 29/890.03 |
| 6,148,906 | A | 11/2000 | Li et al. | |
| 6,167,948 | B1 * | 1/2001 | Thomas | 165/104.26 |

(Continued)

FOREIGN PATENT DOCUMENTS

WO WO 2006/073269 A1 7/2006

OTHER PUBLICATIONS

M. Gao and Y. Cao, "Flat and U-Shaped Heat Spreaders for High-Power Electronics" Heat Transfer Engineering, 2003, vol. 24 No. 3, pp. 57-65, EBSCO Publishing.

(Continued)

*Primary Examiner* — Teresa J Walberg

(57) ABSTRACT

A substrate formed of a suitable conductive-heat-transfer material is formed with small channels of a size selected to provide surface tension forces dominating a motion of a liquid-phase working fluid. A space above the channels of the substrate provides comparatively unobstructed space for the transport motion of a vapor phase of the working fluid effecting a heat-pipe effect in a multi-dimensional device. Channels may typically be formed in an orthogonal grid providing capillary return of liquids from a comparatively cooler condensation region to a comparatively warmer evaporation region, without any wicks other that the adhesion of the liquid phase working fluid to the vertices of the channels. Interference between the boundary layers of the liquid phase and the vapor phase of the working fluid are minimized by the depth of the channels, and the pedestals formed by the channel walls. Extremely small temperature differentials are thereby achieved between an outer surface of the substrate and an inner surface of the substrate when the liquid phase floods the substrate.

26 Claims, 18 Drawing Sheets

U.S. PATENT DOCUMENTS

| | | | | |
|---|---|---|---|---|
| 6,184,578 | B1 | 2/2001 | Gardner et al. | |
| 6,253,835 | B1 * | 7/2001 | Chu et al. | 165/80.4 |
| 6,257,320 | B1 * | 7/2001 | Wargo | 165/80.4 |
| 6,269,865 | B1 | 8/2001 | Huang | |
| 6,269,866 | B1 | 8/2001 | Yamamoto et al. | |
| 6,298,332 | B1 | 10/2001 | Montague | |
| 6,301,109 | B1 * | 10/2001 | Chu et al. | 361/690 |
| 6,381,845 | B2 | 5/2002 | Ikeda et al. | |
| 6,382,309 | B1 | 5/2002 | Kroliczek et al. | |
| 6,397,935 | B1 | 6/2002 | Yamamoto et al. | |
| 6,415,860 | B1 * | 7/2002 | Kelly et al. | 165/148 |
| 6,951,243 | B2 * | 10/2005 | Nilson et al. | 165/104.21 |
| 2002/0011330 | A1 * | 1/2002 | Insley et al. | 165/133 |
| 2002/0020518 | A1 | 2/2002 | Li | |
| 2002/0179284 | A1 * | 12/2002 | Joshi et al. | 165/80.3 |
| 2003/0085024 | A1 * | 5/2003 | Santiago et al. | 165/104.11 |
| 2006/0002087 | A1 * | 1/2006 | Bezama et al. | 361/699 |
| 2006/0157227 | A1 * | 7/2006 | Choi et al. | 165/104.21 |
| 2007/0227704 | A1 * | 10/2007 | Nagai et al. | 165/104.33 |
| 2009/0139693 | A1 * | 6/2009 | Qu | 165/80.4 |

OTHER PUBLICATIONS

Darrell Dunn, Next up in Liquid-Cooled Chips, InformationWeek.com, Nov. 6, 2006, p. 18.

Sandia National Laboratories, Inexpensive Sandia substrate keeps today's hot chips cooler, http://www.sandia.gov/media/heatpipe.htm, 5/31/200, 3 pages.

* cited by examiner

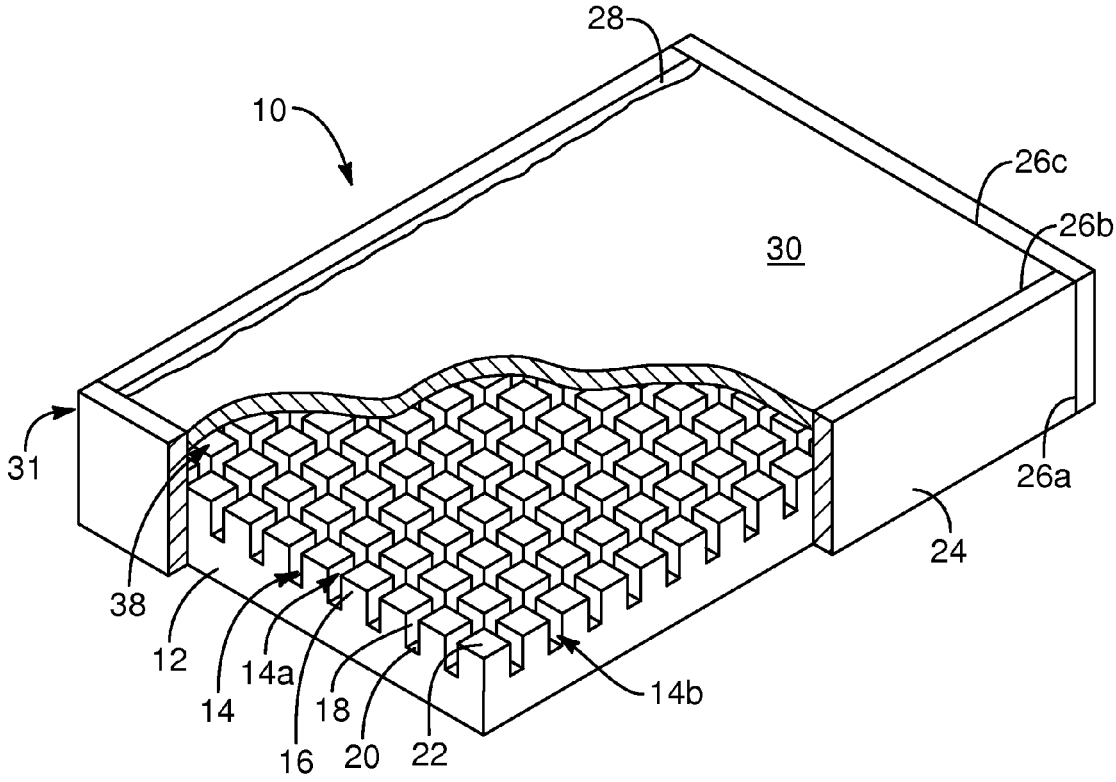
FIG. 2
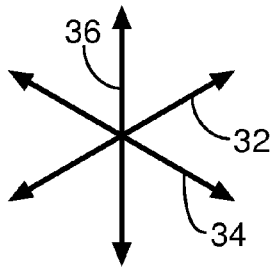

| Heat Transfer Medium | Mass (kg) | Temperature Drop (K) Between Heat Source and Heat Sink | Effective Thermal Conductivity (W/mK) | Effective Thermal Conductivity/mass (W/mK)/kg |
|---|---|---|---|---|
| Solid Aluminum Plate | 2.33 | 35 | 237 | 102 |
| Solid Copper Plate | 7.72 | 21 | 401 | 52 |
| Composite Panel with Poly Wick | 0.76 | 31 | 269 | 354 |
| Composite Panel with Capillary Channels | 0.76 | 1.4 | 6410 | 8434 |

FIG. 21

MINIMAL-TEMPERATURE-DIFFERENTIAL, OMNI-DIRECTIONAL-REFLUX, HEAT EXCHANGER

RELATED APPLICATIONS

The present application claims the benefit of co-pending U.S. Provisional Patent Application Ser. No. 60/836,901, filed Aug. 9, 2006 for CHANNEL-PANEL HEAT TRANSFER DEVICE and co-pending U.S. Provisional Patent Application Ser. No. 60/861,583 filed Nov. 29, 2006 for MINIMAL-TEMPERATURE-DIFFERENTIAL, ISOTROPIC-FLOW, REFLUX HEAT EXCHANGER.

BACKGROUND

1. The Field of the Invention

This invention relates to heat pipes, and more particularly to two-dimensional flows of liquid and vapor through wickless channels to maximize flows of vapor and liquid, minimize the effect of obstructions and hot spots, and minimize temperature differentials between a source of heat and a heat sink.

2. The Background Art

Heat exchangers are well documented throughout engineering literature as mechanisms for exchanging heat between media, moving heat from one place to another, and other means for energy transport. Typically, heat is transferred by conduction, convection, radiation, or a combination thereof. Heat transfer may or may not include a phase change of a working fluid involved in the heat transfer. That is, for example, a material may operate as a working fluid and change phase between liquid and vapor in order to capitalize on the large latent heat value of vaporization. Similarly, certain heat transfer mechanisms used in space craft and for highly sensitive optical detection may rely on the latent heat of vaporization or the latent heat of phase change from solid to liquid or vapor found in materials such as helium, hydrogen, nitrogen, water, alcohol, refrigerants or the like.

One mechanism for heat transfer has been embodied in a heat pipe. Heat pipes generally rely on a hot end that receives thermal energy from a source of heat. At the hot end of the heat pipe, a temperature differential between a heat source and a working fluid inside a sealed heat pipe will drive heat into the working fluid, vaporizing the liquid. The vapor, due to its expansion and resulting pressure differential will flow to the opposite or cold end of the heat pipe. At the cold end of the heat pipe, a heat sink in thermal contact with the pipe receives heat from the vapor, sealed within the heat pipe, but releasing energy to the pipe, which then transfers it to the heat sink. Upon loss of the thermal energy at the cold end of the heat pipe, the working fluid in its vapor phase condenses to a liquid phase.

Liquid accumulating at the cold end of a heat pipe condenses into a wick member, by which is meant generally and herein as a bundle of fibers of such comparatively small size as to promote capillary action there along due to surface tension as a dominant force acting on liquids therein. The wick carries the liquid by capillary action from the cold end of the heat pipe back to the hot end of the heat pipe. Liquid arriving at the hot end of the heat pipe then repeats the cycle of vaporization, transport, condensation, and return by capillary action from the cold end to the hot end.

In many environments, relatively modest temperature differentials are available. That is, for example, in a furnace, hundreds if not thousands of degrees of temperature difference may exist between one portion of the device and another.

By contrast, in space craft, optical devices, electronic equipment, and the like, it may be highly desirable for the equipment to operate very close to the temperature of a sink to which heat is rejected, or even ambient temperatures. Operating close to ambient temperatures provides very little temperature differential to drive heat transfer. Typically, heat pipes require temperature differentials of many degrees. For example, it is not uncommon to find a heat pipe in which the temperature differential between a heat source and the liquid in the wick is over 20° due to the thermal impedance between the heat source or sink external to the pipe and the surfaces inside the pipe where vaporization and condensation occur. Larger temperature differentials drive larger amounts of heat. Nevertheless, developing a heat pipe mechanism that can operate with smaller temperature differentials would be very desirable.

It has been determined that most of the temperature drop between a heat source, or even between the outer wall of a heat pipe, and the liquid at the hot end of a heat pipe actually occurs across a vapor gap. That is, liquids have a property called surface tension, This is a measure of the tendency of a liquid to adhere to itself. Liquids may also have a certain surface tension characteristic with respect to solids within which they may come in contact. That is, a liquid has an adhesive property with respect to a solid, and sometimes a repulsion property, since some liquids and some solids actually do not adhere.

Nevertheless, a liquid tends to adhere to itself during flow according to its mass, viscosity, flow conditions, and its surface tension. At small relative dimensions, surface tension becomes a very significant property and the surface tension forces become significant in the overall flow of a working fluid.

Thus, in a heat pipe, liquids tend to adhere to themselves. The result is that the liquid adheres to itself in a body or stream within a wick, leaving a vapor-gap between the liquid in the wick, and the solid wall against which a wick may rest. Thus, although a wick theoretically maintains a liquid film within itself, and against a heated wall, the practical reality is otherwise.

This is perhaps not amazing, since the hot end of a heat pipe is continually generating vapor. Thus, the fluid dynamics and heat transfer characteristics in the hot end of a heat pipe would be expected to maintain both liquid and vapor phases in close proximity. Accordingly, the liquid phases tend to stay to themselves within the wick material, while the vapor phases tend to be generated at the hottest portions and migrate away therefrom toward the cooler end of the heat pipe.

Thus, vapor gaps cause very large relative temperature differentials to exist between the hot wall of a heat pipe, and the liquid surface of a working fluid in the wick. Depending on the heat flux, and the particular dynamics and dimensions of the heat transfer system, a heat pipe using water or alcohol at or near ambient conditions may have a substantial temperature differential between the hot wall and the liquid interface in a wick carrying liquid working fluid back to the hot end of the heat pipe.

Meanwhile, at the opposite or relatively cooler end of a heat pipe, both phases of the working fluid exist again. That is, the vapors must contact a cool surface at the cold end or cool end of the heat pipe, condense thereat, then make their way into the wick to begin their passage back to the hot end. The accumulation and collection process is necessarily occurring on a very small scale. The scale can actually be at a molecular level, as the individual molecules of liquid condense and agglomerate.

Once again, liquid will tend to adhere to itself, and a vapor layer may exist between a liquid surface in a wick, and the cold end of the heat pipe. That is, at the wall, liquids may actually not come in contact with the surface of the heat pipe, on the inside. For example, vapors may simply contact liquids in the wick and condense. The liquid surface tension may tend to keep liquid away from the wall. As a practical matter, with such dynamics of fluid and heat flows, a large temperature differential may also exist at the cool end of a heat pipe. The temperature differential is of course commensurate with the temperature differential at the hot end. Thus, it appears that a vapor jacket or layer may still form due to the inherent property of surface tension.

As a practical matter, a thinner capillary wick completely full of liquid might tend to avoid establishment of a vapor layer between a wall and a liquid surface in a wick. However, wicks cannot be so easily controlled, and the dynamic activity of a heat exchange system does not necessarily lend itself to an optimization of a wick thickness. That is, the amount of liquid, the flow of liquid, the temperature differentials, the flow pressures, and the like are dynamics along the entire length of a heat pipe. Accordingly, optimizing for any one location would typically move another process a different location out of its optimal set of parameters.

All systems have bottlenecks. That is, in any process, including chemical reactions, industrial processes, traffic patterns, heat pipes, mass flows, heat transfer paths, and the like some limiting rate occurs at some limiting location. Very few systems are optimized to operate at their perfect conditions at all locations within the system, and particularly not at all times and under all conditions. Such is antithetical to the principles of physics. Thus, vapor flows may be obstructed or restricted due to the fluid dynamics of their passage along some conduit or enclosed path. Likewise, the flow of liquids may be restricted by the fluid dynamics of the liquid in its environment, as well as various obstructions along the path including turns, blockages, and the like.

Thus, it would be an improvement in the art of heat pipes to provide two situations that do not appear present in heat pipe design. The first is to provide a mechanism to avoid obstructions, and thus permit vapors to flow in any direction between a comparatively hotter area of a heat pipe, and a comparatively cooler area of a heat pipe. Similarly, it would be an advance in the art to provide a multiplicity of paths for liquids, or a liquid working fluid within a heat pipe, to travel from a condensate location near the cooler portion of the heat pipe back to a hotter area where it is needed for flooding and cooling an area. Likewise, if a heat pipe has a particularly, comparatively hotter portion that tends to dry out, it would be an advance in the art to be able to provide liquid from multiple directions to that location in order to reflood the area as vapor is boiled off.

Likewise, it would be an advance in the art to develop a mechanism whereby separation of a liquid surface from the wall of the heat pipe is minimized. It would be a significant advance in the art to implement a mechanism whereby the liquid is kept in contact with the wall of a heat pipe, preferentially, thus allowing no vapor layer to interfere. Thus, the temperature differential between an outer wall, and a liquid surface against an inner wall of a heat pipe would be substantially minimized.

It would be another advance in the art if the thickness of a wall of a heat pipe were minimized in order to reduce conductive resistance. Thus, it would be an overall improvement in the art of heat pipes to create a heat pipe having little or no wick, yet providing good adhesion of a liquid working fluid against a wall near the hotter end of a heat pipe, in order to maintain flooding of the area with liquid heat transfer fluid.

Likewise, it would be a substantial advance in the art to provide flooding of a hot area of a heat pipe from multiple directions with equal ease, effectively isotropically with respect to all available flow directions, providing a substantially uninhibitable flow, from multiple directions in or out of plane with respect to a hot spot. It would be another advance in the art if liquids could be kept at or near the surface, flooding the hot areas of a heat pipe, by returning from the cooler areas of the heat pipe through multiple available paths.

It would also be an advance in the art to minimize the stripping (e.g., entrainment) of liquid out of the liquid flow by passing vapors.

In heat pipe design vapors are typically provided larger volumes in which to travel than are liquids, vapors typically have a volume on the order of one thousand times greater that the equivalent mass of a liquid. Accordingly, vapors traveling through the same space as liquids must have one thousand times the volume (or whatever their vapor-to-liquid volume ratio is and a corresponding ratio of velocities on a given area.) However, at the interface between a liquid traveling from the relatively hotter end to the relatively cooler end of a heat pipe, vapors travel at a relatively high rate of speed, stripping liquid from the surface of the liquid traveling in the other direction. Entrainment of liquids into vapor flows tends to inhibit reflooding the hot end of the heat pipe by liquids. Thus, a mechanism for separating the flows, may be desirable. A mechanism for automatically separating the flows, and sharing the available volume while still stabilizing the liquid flows against entrainment by vapors would be an advance in the art.

BRIEF SUMMARY OF THE INVENTION

In accordance with the foregoing, an apparatus and method in accordance with the invention may include a first surface extending at least in two directions, mutually orthogonal to one another. Other surfaces may extend from this surface in order to form channels or the walls of a channel entering the first surface as a bottom of such channels. A working fluid passing continuously and substantially isotropically through the channels may actually travel in both the first and second directions. That is, the second surfaces may be formed as pedestals amid a grid of channels. Thus, the floor of the channels may be formed as a single continuous layer, and may be in a single plane.

The walls of the channels, may be broken in order to provide many intersecting channels. The channels may intersect at any suitable angle, including, for example 20, 30, 45 degrees, or their complements, as well as 90 degrees. Also, the short diagonal points of the resulting diamond shapes formed by such channels may be traversed by other channels or not. Nevertheless, in one currently contemplated embodiment, one set of parallel channels may be thought of as rows. These may be intersected by a second set of parallel channels (thought of as columns if located at right angles). Accordingly, the vertices (intersections of surfaces) at the base of each channel (along the floor) may serve as capillaries, adhering liquids in the corners. Liquid may cover the entire bottom floor of each channel depending on flow rate and channel sizing.

In another embodiment, two ranks of parallel channels may be formed at an acute angle with respect to one another. A third rank of parallel may also be added, for example to bisect the resulting obtuse angle between the first two ranks. One embodiment using all three such ranks provides six paths converging at each intersection and spaced at equidistant angles.

Vertices may be sized in a correspondence with the width of the channel in order that capillary action at every resulting intersection of channels has about an equal flow resistance (or, alternately, propensity) in any direction.

That is, if a liquid approaches an intersection of two crossing channels from one direction, it has three choices of a direction in which to continue. If each of these directions presents substantially the same resistance to flow or presents the same propensity to flow, then all three are equally available, and flow is substantially isotropic among them. Whether or not walls are porous in the apparatus, actual isotropy overall space does not exist. Rather, flow propensity and resistance at each intersection is substantially isotropic among available paths. In one currently contemplated embodiment, a grid of channels may be machined, cast, molded, or otherwise formed into a solid plate or substrate of material. If flows are slower, then even a grid of channels not orthogonal may be substantially isotropic. As flow rates increase, such substantial isotropy decreases.

One might think of the channels as having interior vertices nominally (horizontally) along the floor, which vertices are broken up at each intersection by a cross-channel intersection therewith. Likewise, each pedestal formed by a wall of a channel heading in a first direction, as it intersects the wall of another channel, may also serve as a point of capillary accumulation of liquids.

In one embodiment of an apparatus and method in accordance with the invention, liquids may travel along channels of a capillary grid as described above, having an equal resistance or propensity to flow in any channeled direction at any intersection.

As a liquid phase of a working fluid receives heat at a warmer end or simply a warmer location along a two-dimensional surface of a substrate, the liquid will eventually change phase and become a vapor. In one embodiment, substrate with its channels and the pedestals may actually be enclosed by a minor image of itself, providing pedestals as a ceiling to a heat pipe mechanism. In one presently contemplated embodiment, two plates, each having a grid of channels formed therein, may be placed "face-to-face," typically with a spacing between the tops of the pedestals forming the channels to form an assembly.

Thus, a vapor may pass between the plates unimpeded, and unrestricted by the actual walls of the channel. Meanwhile, the presence of the pedestals formed by the intersecting channels may sufficiently form a slower boundary layer region for the vapor phase such that the vapor phase will not entrain any substantial amount of the liquid in the channels below the open "tops" of the pedestals.

If a high volume of liquid is condensing at a particularly cooler location on a surface of a heat pipe, then a liquid may actually overfill a channel, and may flow in the vapor space. Having the ability to carry liquids in two dimensions, any accumulation of liquid tending to overfill a channel has the ability to quickly dissipate in all available directions.

In operation, one embodiment of an apparatus and method in accordance with the invention may carry a liquid operating fluid, or a liquid phase of an operating fluid along the vertices of comparatively small channels toward a comparatively hotter location on the assembly. At the hotter location, some or all of the liquid may be vaporized by the influx of heat through the wall of the substrate, and thus begin its return trip back toward the comparatively cooler locations on the assembly.

Of course, multiple assemblies may be connected with conduits, which may be designed to experience no substantial heat transferred through the walls thereof. Nevertheless, in certain embodiments, a single, continuous assembly may operate with fluids moving between a comparatively hotter and a comparatively cooler location thereof to transfer heat through the phase change, heat transfer, and mass transport of fluid in the assembly in accordance with the invention.

An apparatus will typically deliver heat to a comparatively cooler location at which a vapor phase of the working fluid will condense proximate a wall thereof, and typically at an inner surface of the substrate, to become the liquid phase of the working fluid. Supporting and promoting capillary action is therefore an advantage of this invention. Channels with their comparatively small dimensions are sized to render surface tension forces a significant transport mechanism due to capillary action. Comparatively cooler areas will then accumulate liquid, and transfer it back from the source or origin of the liquids toward the drying and comparatively hotter portion of the channel or the assembly.

As a practical matter, a plurality of small channels on the order of a few thousandths, to about less than ¼ of an inch in width, and having a comparable depth, have been found to form excellent transport mechanisms for maintaining capillary action. A two-dimensional plate having a grid of orthogonal channels of substantially equal width and depth, as well as pitch (distance from the beginning edge of one channel to the beginning edge of the next adjacent channel) has been found to distribute flows with substantially isotropic distribution.

It is not required that the floor of all the channels be in a single plane, nor that every channel be exactly of the same width or wall height. Nevertheless, the presence of an exactly regular configuration such as exactly parallel channels on an exactly repeating pitch, with cross-channels arranged orthogonally thereto with exactly the same dimensions, provides a high degree of isotropy extremely valuable in eliminating any penalty for a liquid or vapor taking any direction or path of choice.

Thus, for example, a system of channels or an assembly in accordance with the invention, may have a source of heat in contact therewith near the center thereof. Meanwhile, heat sinks may be located at the edges or at one or more of the four corners of such a device. The "hot spot" near the center of the assembly will then be flooded from all directions along the assembly with liquid. Moreover, the liquid from any particular, comparatively cooler area may flood back toward the hot spot along any path desired.

If one particular heat sink is capable of carrying away more heat, then it may take more of the vapor phase, condense it, and thus send back a larger proportion of the liquid to cool the hot spot. Thus, in accordance with the invention, it is contemplated that a liquid may be sent by any suitable path or combination of paths back from a "wetter" cooler area toward a "dryer" hotter area.

In another example, a hot spot may be located at any location within the perimeter of an assembly of arbitrary, two-dimensional shapes in constructed in accordance with the invention. Meanwhile, a heat sink may be located at any particular location away from the hot spot. Liquids can then return from the cooler area whereat a heat sink is condensing the vapors of the working fluid, in all available directions to completely surround the hot spot and flood it from any particular direction, not solely from the direction in which the cooler location stands with respect to the comparatively warmer (e.g. hotter) location.

The channels may be manufactured with comparative ease by a number of manufacturing methods if the channels are fabricated in a straight line and parallel to one another in each desired dimension. In this way, isotropy is promoted. The depth of the channels and the proportion between the depth of the channels and the depth of the space above the channels may be sized to optimize the relative rate of flow of liquid-phase working fluid in the channels, as compared with the corresponding passage of the vapor-phase working fluid passing thereabove in the opposite general direction.

In some embodiments, standoffs may be fabricated to space two substrates, or plates provided with channels in accordance with the invention, away from one another. In other embodiments, a "floor" substrate may be provided with channels while the "ceiling" substrate contains no channels. For example, in larger gravity environments, such as the common earthbound structure, there may be less benefit to having channels on both sides of an assembly in accordance with the invention.

Nevertheless, if a heat source is in thermal contact with a lower assembly while a heat sink is in contact with an upper assembly, a benefit may exist in providing two substrates each provided with channels. These bases placed opposite one another may or may not be minor-images of one or another. Likewise, if an assembly in accordance with the invention is operated in a vertical orientation, wherein the "plane" of pedestal tops is vertically oriented, and orienting the comparatively hotter location of the assembly lower, and the comparatively cooler location of the assembly higher, may provide certain benefits of gravity for promoting flows of the working fluid.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 2 is a partially cut-away, perspective view of one embodiment of a sealed assembly for heat transfer in accordance with the invention;

FIG. 21 is a table presenting experimental data from testing an apparatus in accordance with the invention.

DETAILED DESCRIPTION OF THE PREFERRED EMBODIMENTS

Figure 1:
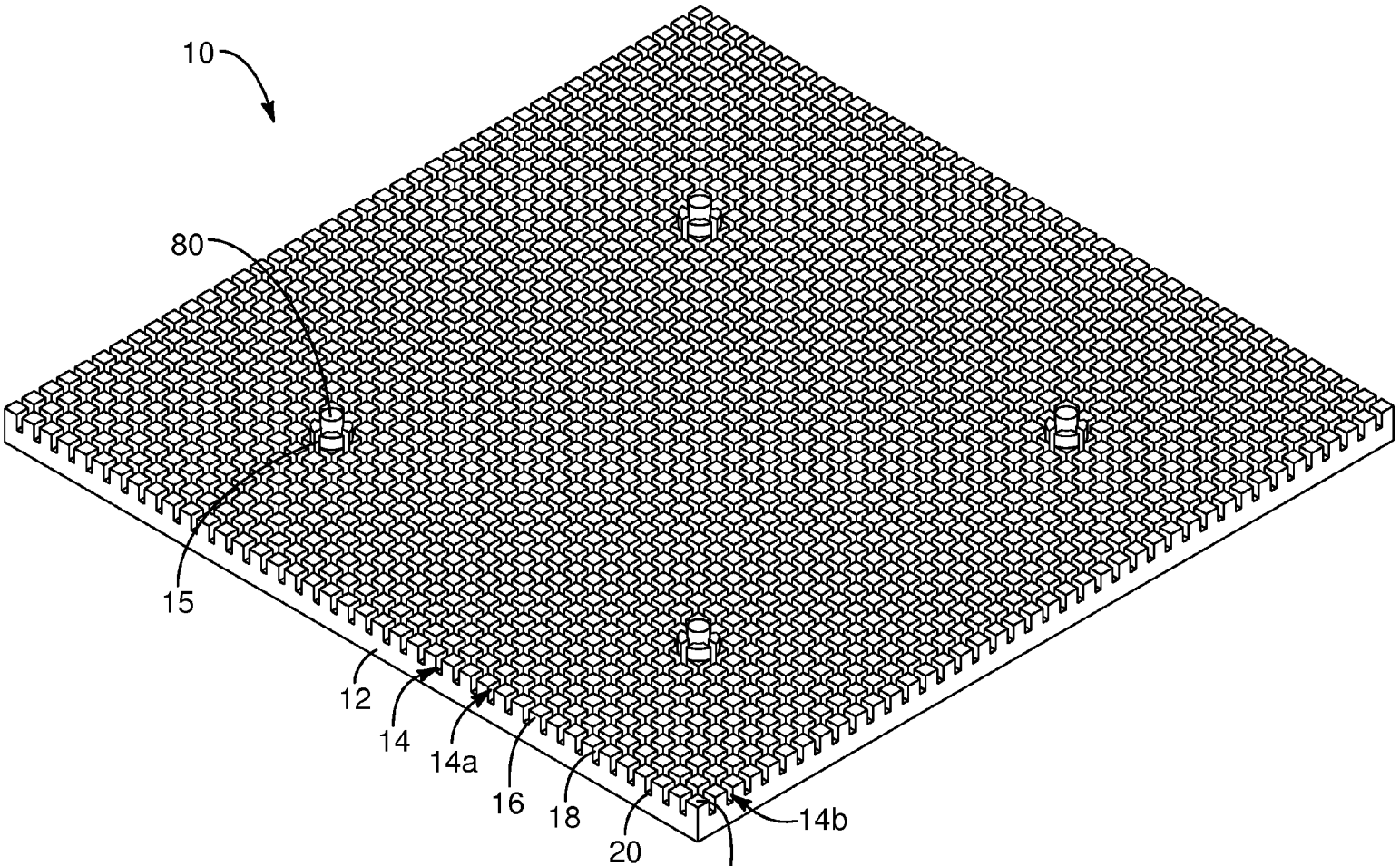
FIG. 1 is a perspective view of one embodiment of a base or substrate suitable for use in an assembly having capillary channels for heat transfer in accordance with the invention.

Referring to FIGS. 1-4, an apparatus 10 in accordance with the invention may be formed to have a base 12 formed of a material suitable for heat transfer. Typical materials may be metals such as aluminum, copper, steel, and the like. In certain embodiments, materials of comparatively lower thermal conductivity such as polymers, polymer composites, and carbon-carbon composites have successfully been used. Aluminum has been found to be an excellent heat transfer material. Likewise, gold and precious metals have excellent heat transfer characteristics, in spite of their exorbitant costs for most applications. In certain embodiments, various varieties of steel and other metals are also suitable.

In certain embodiments, applicants have manufactured plastics having suitable heat transfer characteristics if view of the close proximity of the internal surfaces, at which phase changes occur, to the external surfaces in contact with the heat source or sink. This direct wetting of internal surfaces improves over conventional wick systems, as demonstrated by low temperature differentials (e.g. a few degrees) between heat source and heat sink regions of the apparatus 10, as opposed to tens of degrees or more in conventional systems.

In one embodiment of an apparatus and method in accordance with the invention, channels 14 are formed within the base 12 or substrate 12 of the material. Each channel 14 is formed to be of a size that promotes the surface tension forces of a liquid working fluid used with the apparatus 10. Typically, pedestals 16 are formed by the array of channels 14 and cross-channels 14 (e.g. 14*a*, 14*b* respectively) intersecting one another. The channels 14 may intersect one another at right angles, or some other angle (e.g. 10, 20, 30, 40, 45 degrees). In one presently contemplated embodiment, right angle channels become extremely simple to manufacture, and provide a substantially isotropic flow of liquid phase working fluid throughout the channels from one location to another separated therefrom.

Each of the walls 18 of a channel 14 forms a wall 18 of a pedestal 16. That is a floor 20 may be thought of as the surface extending along the dimensions of the base 12, while the pedestals 16 extend away therefrom. Meanwhile, each of the pedestals 16 forms part of an interrupted wall 18 along the corresponding channel 14 bounded thereby.

A top 22 of a pedestal 16 may be formed to be in contact with the working fluid in either the liquid phase, vapor phase, or both. In certain embodiments, the top 22 may actually be sealed off so that all fluid flow passes through the channels 14, rather than across the open space thereabove. In order to operate with two phases of a working fluid, the apparatus 10 is sealed to operate as a heat pipe. In certain embodiments, the apparatus 10 need not be sealed, and a continuing flow of available liquid may flood and be transported away. However, in embodiments most often contemplated by heat transfer systems, a sealed system provides for recycling of evaporating working fluid, thus precluding fouling and other conditions that exist in open systems.

The apparatus 10 may be formed to have an edge wall 24 formed either integrally, homogeneously, or separately from the base 12. In the illustrated embodiment of FIG. 2, the edge wall 24 is secured to the base 12, and sealed by a sealant 28 such as a caulking, weld, molding, solvent, adhesive, or the like, according to the material characteristics of the apparatus 10. In one embodiment, the sealant 28 is a weld formed to seal together metals of the edge walls 24 at interfaces 26. (Trailing letters behind numerals indicate different instances of the same structure identified by the numeral.)

The cap 30 or ceiling 30 in the apparatus 10 typically encloses the working fluid in an environment otherwise evacuated to have substantially only the two phases of the working fluid therein. Typically, an apparatus 10 may include one or more of the assemblies 31 formed of the base 12 or substrate 12, and ceiling 30 or cap 30 with their walls 24. Nevertheless, in an apparatus 10 formed of a single assembly 31, the typical shape may be planar in general, extending in a longitudinal direction 32 and a lateral direction 34. The dimension of the apparatus 10 or assembly 31 in the transverse direction 36 is typically the comparatively smallest of the three.

In general, the transverse direction 36 may not be a substantial direction of mass transport or heat transfer along the apparatus 10. Nevertheless, the gap 38 extending in the transverse direction between the pedestals 16 and the cap 30 whether or not it is channeled (as it is in the typical apparatus 10) provides space for the mass transport of vapor-phase working fluid between a comparatively hotter location in the apparatus 10 and a comparative cooler location where the vapor phase condenses into the liquid phase for return by capillary action along the channels 14. The base 12 and cap 30 may be spaced apart by spacers 80 having channels 14 continuing and connecting channels 14 in the base 12 and cap 30.

Figure 3:
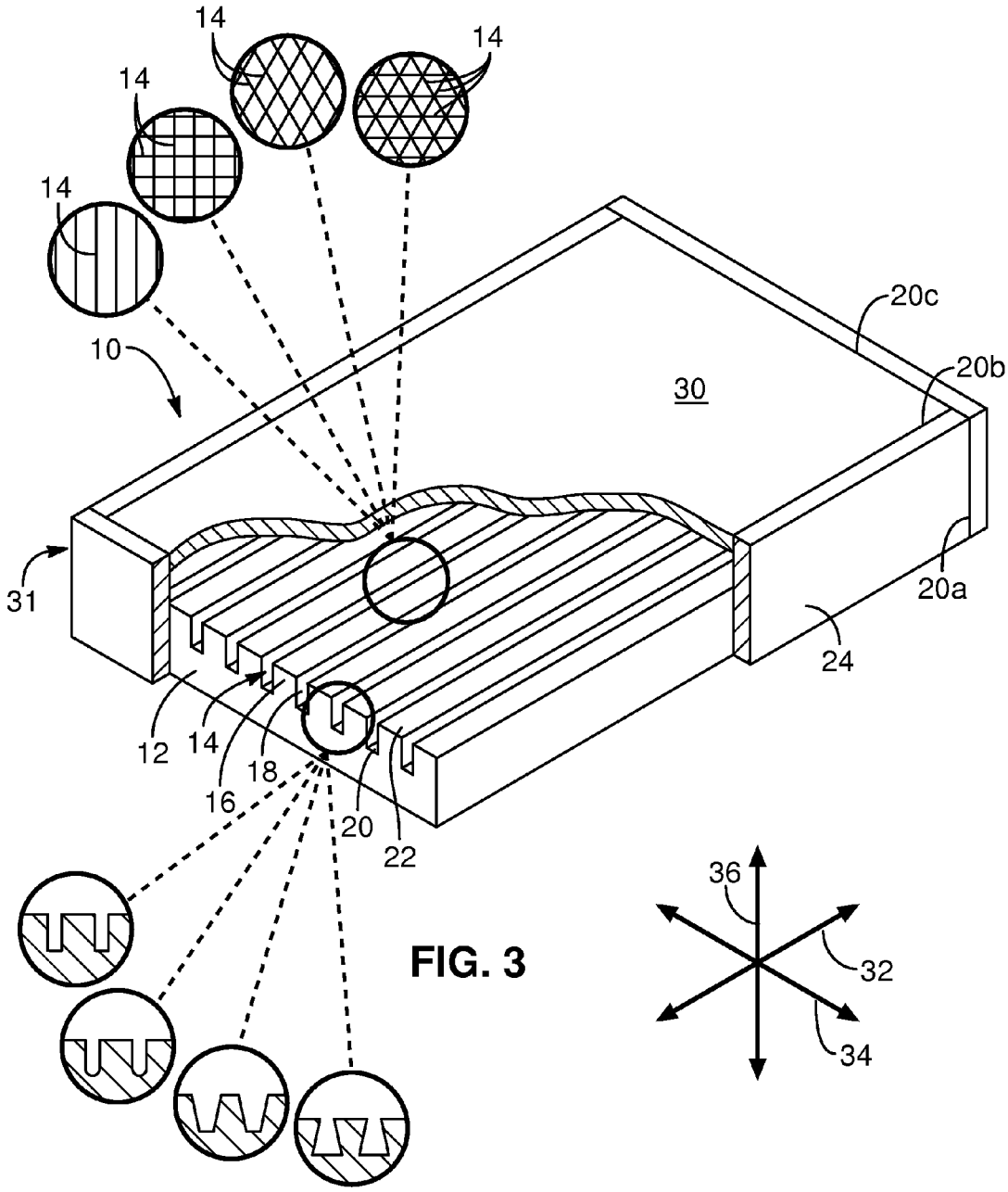
FIG. 3 is a partially cut-away, perspective view of an alternative embodiment of an assembly in accordance with the invention with insets showing some alternative layouts of channel intersections and other insets showing some alternative channel cross sections.

Referring to FIG. 3, while continuing to refer generally to FIGS. 1-4, an apparatus 10, may also be formed with channels 14 extending in only one longitudinal direction 32. In such a configuration, fluid transport between channels may be inhibited. However, in many applications, where a comparatively longer path exists between two comparatively more compact areas of heat source and heat sink, isotropic distribution between channels may not be as important. Extrusions, even extrusion of plastic materials may form a suitable apparatus 10 or substrate 12 with channels 14 therein.

Nevertheless, the benefit of fluid flow in two dimensions provides a significant assist to removing hot spots or cold spots in the apparatus 10. Re-flooding from all sides has been found to be extremely effective. Thus channels typically will intersect. Cross sections are selected to promote or optimize capillary return of liquids. The gap 38 between the cap 30 and the substrate 12 or pedestals 16 is selected to optimize return of vapor. Suitable cross sections for the channels 14 are numerous. Some examples are shown in the insets below the apparatus 10 of FIG. 3. Likewise, angles of intersection of channels 14 as viewed from a plan view of the substrate 12 of an apparatus 10 may be of any suitable angle. Examples are shown in the insets above the apparatus 10.

Figure 4:
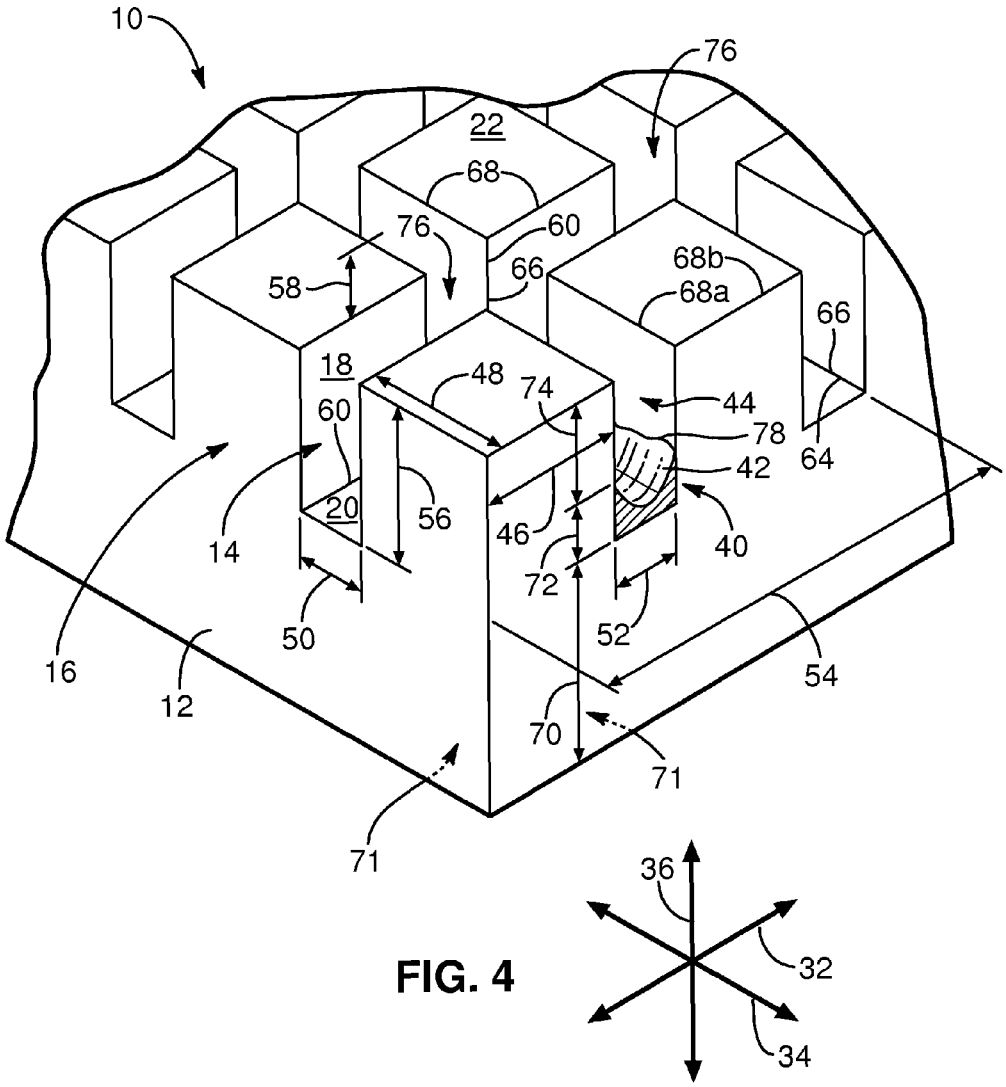
FIG. 4 is a perspective view of channels and resulting pedestals from the intersections thereof in the substrate of an assembly in accordance with the invention, such as those of FIG. 1 and FIG. 2.

Referring to FIG. 4, working fluid 40 operates as a liquid 42 or liquid phase 42 operating typically along the floor 20 of a channel 14. By contrast, the vapor 44 or the vapor phase 44 of the working fluid 40 typically passes along through the gap 38 or the region 38 between the base 12 and cap 30. In general, each of the pedestals 16 may have a length 46 in the longitudinal direction and a width 48 in the lateral direction, as well as the portion of the floor 20 having a width 48 in the lateral direction. In certain embodiments, the width 48 of the pedestal, and the width 50 of the floor may actually be the same distance.

In order to promote or maintain "isotropy" (e.g. substantially equal tendency toward flow into all available channels 14) at each of the intersections of channels 14, all channels 14 may be of similar dimensions, while there may be no particular benefit to having excessive material in pedestals 16 therebetween. One will note that isotropy may exist even though the angle between channels 14 is less than 90 degrees, since capillary forces from surface tension dominate in typical embodiments. When flow velocity becomes so fast that viscous forces dominate capillary forces, the drag effects of corners and corner shapes (e.g. acute angles) may become more important and may even act to destroy isotropy of flow among the channels 14.

The length 46 and width 48 of a pedestal 16 comprise dimensions of the channels 14. Accordingly, minimizing these dimensions is not necessarily productive since they form the vertices for capillary transport. By the same token, maximizing those distances will tend to come at the expense of the volumetric (e.g. carrying) capacity of the channels 14. Therefore, in one presently contemplated embodiment, the comparative dimensions of the length 46, width 48 of the pedestals 16, and the width 50 and length 52 of each channel segment therebetween may be comparable in value.

Likewise, the height 56 of each pedestal 16 may be selected to maximize the fluid flow or minimize the drag on both the liquid flows in the channels 14, and the vapor flows in the gap 38. Of course, the gap 38 may be completely absent and vapors may flow in the channels 14. Nevertheless, it has been found very effective to provide a substantial gap 38 carrying or conducting vapor-phase working fluids and leaving to the pedestals 16 to maintain an enforced boundary layer of vapor above the liquid phase 42 of the working fluid 40 down in the channels 14. Liquid is thus separated from the moving vapor phase by a stagnating vapor or boundary layer.

In general, the dimensions of the channels 14 and pedestals 16 may be selected along with the physical properties such as viscosity, specific heat, latent heat, density, and surface tension of the working fluid 40 in order to optimize the flow of vapor from the comparatively hotter region to the comparatively cooler region and the flow of liquid 42 from the comparatively cooler region to the comparatively hotter region of an apparatus 10 in accordance with the invention.

Values of the height 58 of the gap 38 or region 38 conducting the vapor phase 44 of the working fluid 40 may be selected in accordance of the volumetric flow rate thereof. In certain embodiments tested, the height 56 has been on the order of magnitude of 1 to 4 times the height 56 of each pedestal 16. Nevertheless, the volumetric flow rate desired will control the fluid dynamics of both liquid 42 and vapor 44 phases of the working fluid 40.

In general, any vertex 60 may typically be formed at an angle of 90°. As a practical reality, each vertex 20 may be formed at some angle other than 90°, and may even be greater than 90° as shown in the insets. Nevertheless, it has been found effective to form vertices 62 in the longitudinal direction 32 and vertices 64 in the lateral direction 34, at 90°. In certain embodiments, the vertices 62, 64 may actually be acute angles, thus actually providing a dovetail shape to each channel 14, further isolating the liquid channels 14 from the vapors 44 traveling in the gap 38. Nevertheless, for ease in manufacture and suitable performance, right angles are suitable for the vertices 60.

The vertices 66 along the vertical aspects or the transverse direction 36 of each pedestal 16 may tend to form droplets with condensing vapor as it converts into liquid. The adhesion characteristics or the surface tension relationship is a function of both the liquid with respect to itself, and a function of the liquid properties with respect to the solid properties of the base 12 forming the pedestals 16, The result is the surface tension between the liquid phase 42 and the solid.

Accordingly, one may select the materials for the base 12 and the materials for the working fluid 40 to provide a balance between the surface tension forces and the viscous forces in order to promote an optimized mass transport characteristic along the channels 14 from the comparative cooler region to the comparative hotter region needing to be reflooded by the apparatus 10 in use. For example, specialized treatments with nano-fibers or anodization to promote surface tension may be relied upon to optimize capillary mass transport. Likewise, liquids and solids can be selected to optimize capillary forces.

Vertices 68 along the top surfaces of the pedestal 16 may be formed in any suitable shape. The advantage to forming the vertices 68 as sharp edges is to maintain the stagnation of any vapor phase 44 within the channels 14 in order to avoid stripping or entrainment of liquid from the liquid phase 42 into the vapor phase 44. However, separation also is affected by the height 56 of the pedestals 16. Accordingly, if the liquid phase 42 does not nearly or completely fill the height 56 of the pedestals 16, stripping is less of an issue. Also, in fluid dynamics, the boundary layer typically develops just above the top 22 (as in FIG. 5), and thus the sharp vertices 68 will typically not inhibit the flow of the vapor phase 44 any more substantially than would a solid surface thereat.

One of the great benefits found in forming the apparatus 10 in accordance with the invention is that a thickness 70 between the floor 20 of a channel 14, and the outer surface 71 of the base 12, may be minimized to a very small distance when compared to the height 56 of the pedestals 16. For example, in certain embodiments, the thickness 70 of the floor may be only on the order of the magnitude of a quarter or less of the height 56 of the pedestal 16.

Thus, in certain embodiments, relying on any of several available, common liquids as a working fluid, the pedestal height 56 may be ⅛ inch, while the pedestal length 46 and width 48 may also be about an ⅛ of an inch, and the width 50, 52 of any channel 14 may likewise be about an ⅛ of an inch. In such an embodiment, the thickness 70 of the base 12 below the channels 14 need only be ⅛" to 1/16", and may be less if structurally permissible. In this way, the conduction heat transfer limitation between the outer surface 71 of the base 12, and the liquid phase 42 of the working fluid 40 in the channel 14 may be minimized, with a corresponding minimizing of the temperature differential therebetween.

Such embodiments tend to avoid creating problems in incident to conventional wicks, such as dry regions between liquid phases in a wick and the corresponding wall from which such liquids receive their heat transfer. The height 72 of the wetted portion of the walls 18 of the channels 14 is governed by the fluid properties of the liquid phase 42 of the working fluid 40, as well as the dimensions of the channels 14 and the volume of the fluid 42 available. Accordingly, the height 74 of the dry portion of the walls 18 is the complementary portion of the overall height 72, with respect to the available height 56 of the pedestals 16.

As a practical matter, in some designs, liquids may be permitted to run over the tops 22 of the pedestals in some locations. Nevertheless, in such a configuration, mass transport by convection or hydrostatic pressures in the fluids are often of the same order of magnitude as those due to the surface tension forces, which tend to create a substantial boundary layer drag in the liquid 42, with consequent stripping of liquid.

At each intersection 76, as the fluid 42 travels along the floor 20 of a channel, the meniscus 78 or the edge of the liquid phase 42 may adhere to the walls 18 of the pedestals 16, and the floor 20 of the channels 14. The surface tension property between the liquid 42 and the material of the pedestals 16 or the base 12 will determine the behavior of any meniscus 78 as the fluid flows along the channels 14.

However, once the channels 14 are substantially wetted and carry a continuous stream of fluid, the entire floor 20 may be wetted. Liquid is drawn along by its adhesion to the surrounding liquid 42, as well as the static pressure gradient due to the greater height 72 of the liquid in a channel 14 near a source of condensation (a comparative cooler area) as compared to the shallower height 72 associated with an area of evaporation (a comparative hotter portion) of the apparatus 10.

Figure 5:
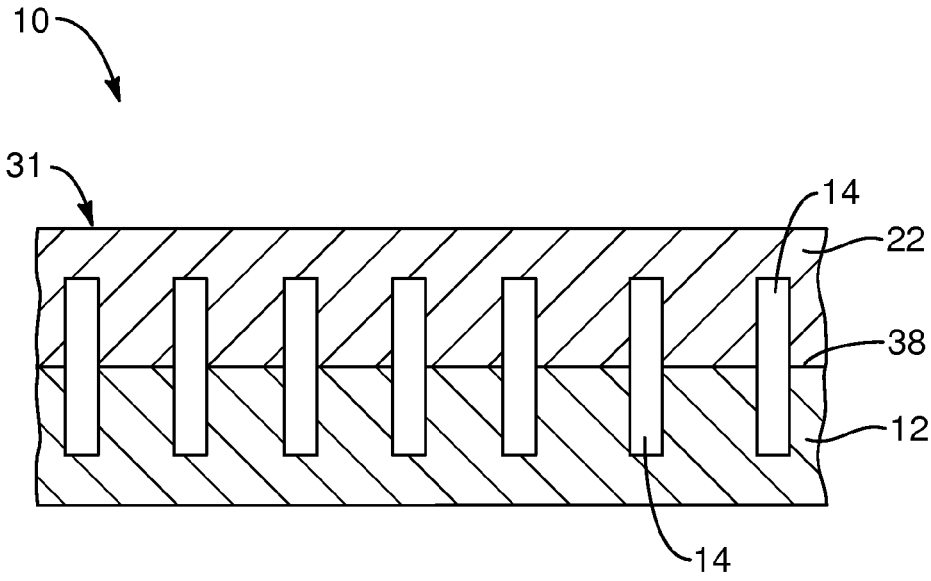
FIG. 5 is a cross-sectional view of an edge of the assembly of FIGS. 1 and 2 in an embodiment wherein the floor and ceiling portions are in exact contact with one another at the top faces of the pedestals forming the channel walls.
Figure 6:
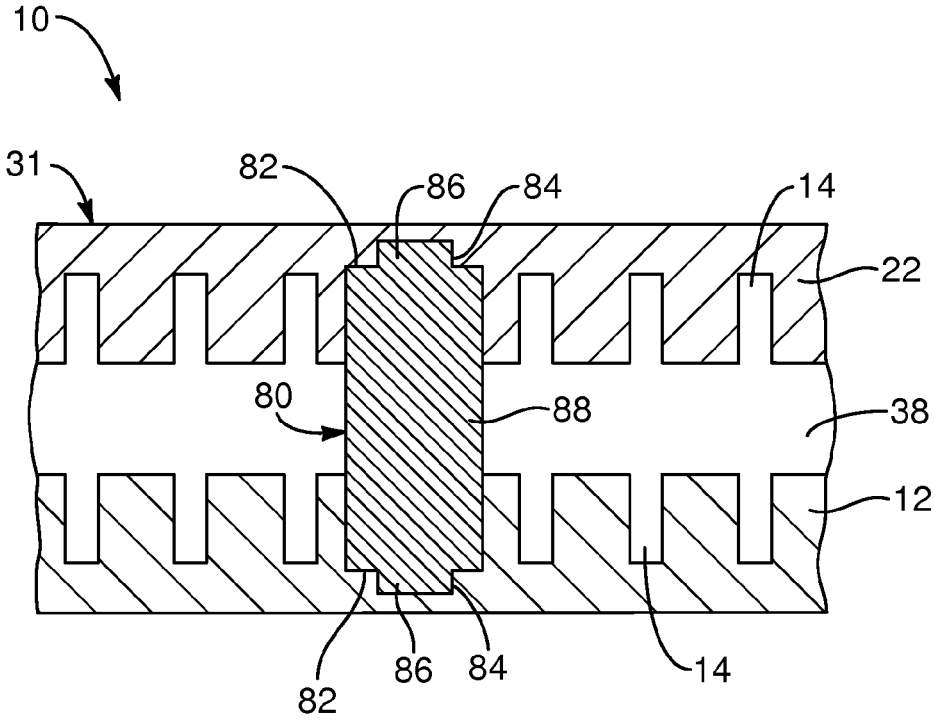
FIG. 6 is a cross-sectional view of an edge of the assemblies of FIGS. 1-4 providing a gap between the tops of pedestals of mirror-image-mounted substrates of the assemblies of FIGS. 1-4.
Figure 7:
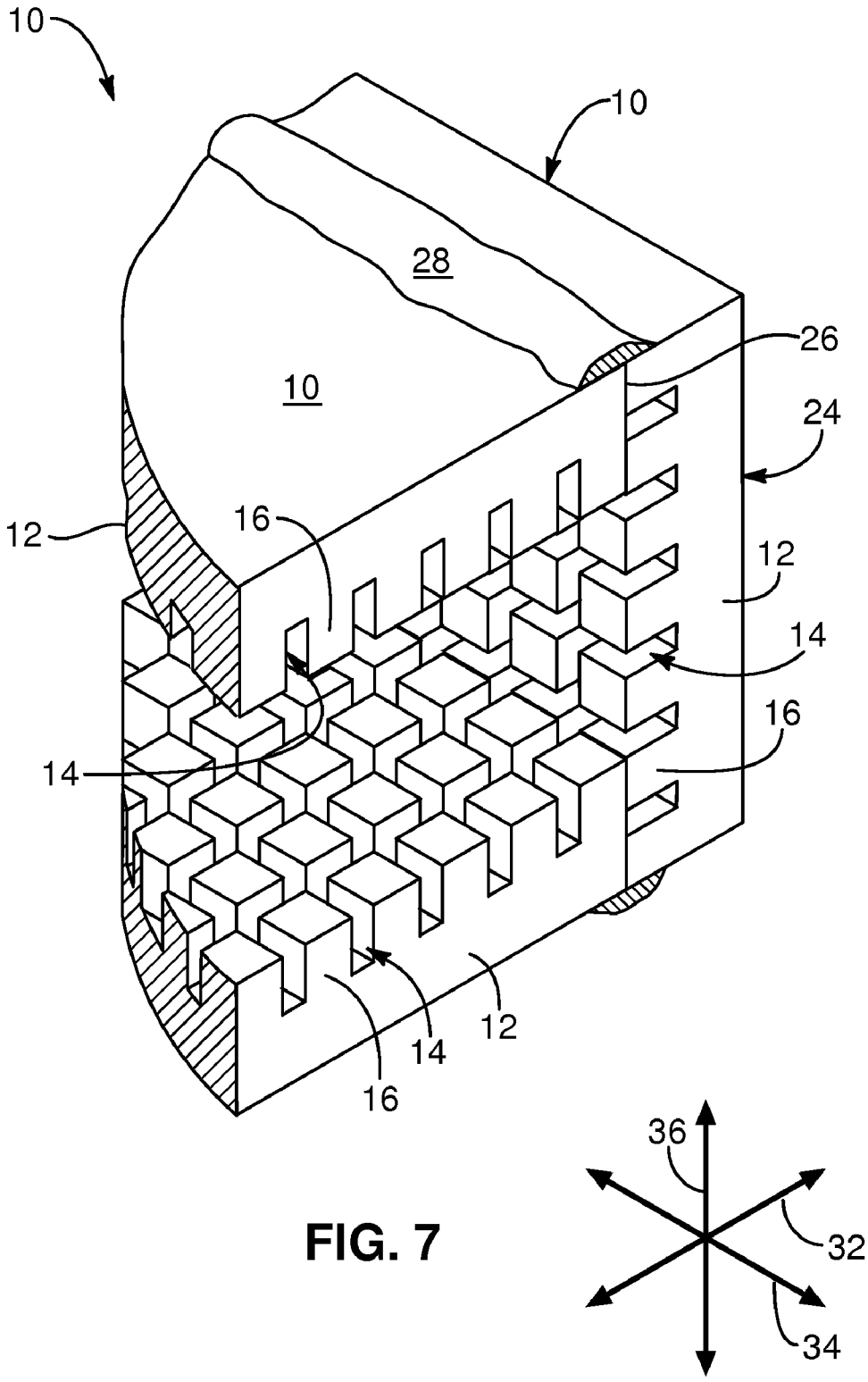
FIG. 7 is a cutaway, sectioned, perspective view of one embodiment of an apparatus in accordance with the invention wherein assemblies such as those of FIGS. 1-4 may be configured in a 3-dimensional configuration.

Referring to FIGS. 5-7, a base 12 provided with channels 14 may be connected to another base 12 as a top 30, in a minor-image fashion. The gap 38 may be reduced to near or substantially zero, or left comparatively larger as illustrated in FIG. 6. However, a vapor phase of a working fluid 40 occupies orders of magnitude more space than does the liquid phase at the same pressure and temperature. Thus, a larger cross-section for the gap 38 reduces flow drag on vapor flows passing from comparatively hot (boiling) areas to comparatively colder (condensing) areas of the apparatus 10. In order to provide the gap 38 of FIG. 6, a spacer 80 may provide to the channels 14 support and a standoff distance to separate the base 12, or the top 22 of a pedestal 16 of the base 12, from the cap 30 across the gap 38. Alternatively, the heights 56 of selected pedestals 16 could simply be extended to provide a standoff periodically within the grid of pedestals 16. Also, each spacer 80 is typically formed with channels 14 therein, aligned with the channels 14 of the base 12 and top 30 to promote fluid communication therebetween.

The spacer 80 may be provided with a shoulder 82 fitted to a portion of the corresponding base 12 or top 22 in order to space them apart. Some type of securement or sealer such as a weldment, swaging, or the like may seal the cavity of the gap 38, secure the spacer 80, or both. A shank 86 or shank portion 86 of the spacer 80 may be secured in any suitable manner, including, for example, a weldment on the outer surface 71 securing a shank 86 flush with or protruding from the outer surface 71, or fitted into a blind hole 84 inside the base 12, top 22, or both. The dimensions of the body 88 may be formed to provide the shoulder 82, spacing the base 12 and plate 30 or cap 30 apart.

Typically, such a spacer 80 may interfere with the flow through the gap 38. Nevertheless, in an apparatus 10 and method in accordance with the invention, an obstruction such as the spacer 80 may simply result in the fluid passing thereabout by selecting channels 14 bypassing the region of the spacer 80.

Referring to FIG. 7, a base 12 having channels 14 and pedestals 16 formed therein may be used as both a base 12, and a cap 30, as well as an edge wall 24. Accordingly, in a microgravity environment, all outer surfaces 71 of the apparatus 10 may actually be capable of performing heat transfer services, while all interior surfaces of the channels 14 may be capable of transporting liquid phase 42 working fluid 40.

Figure 8:
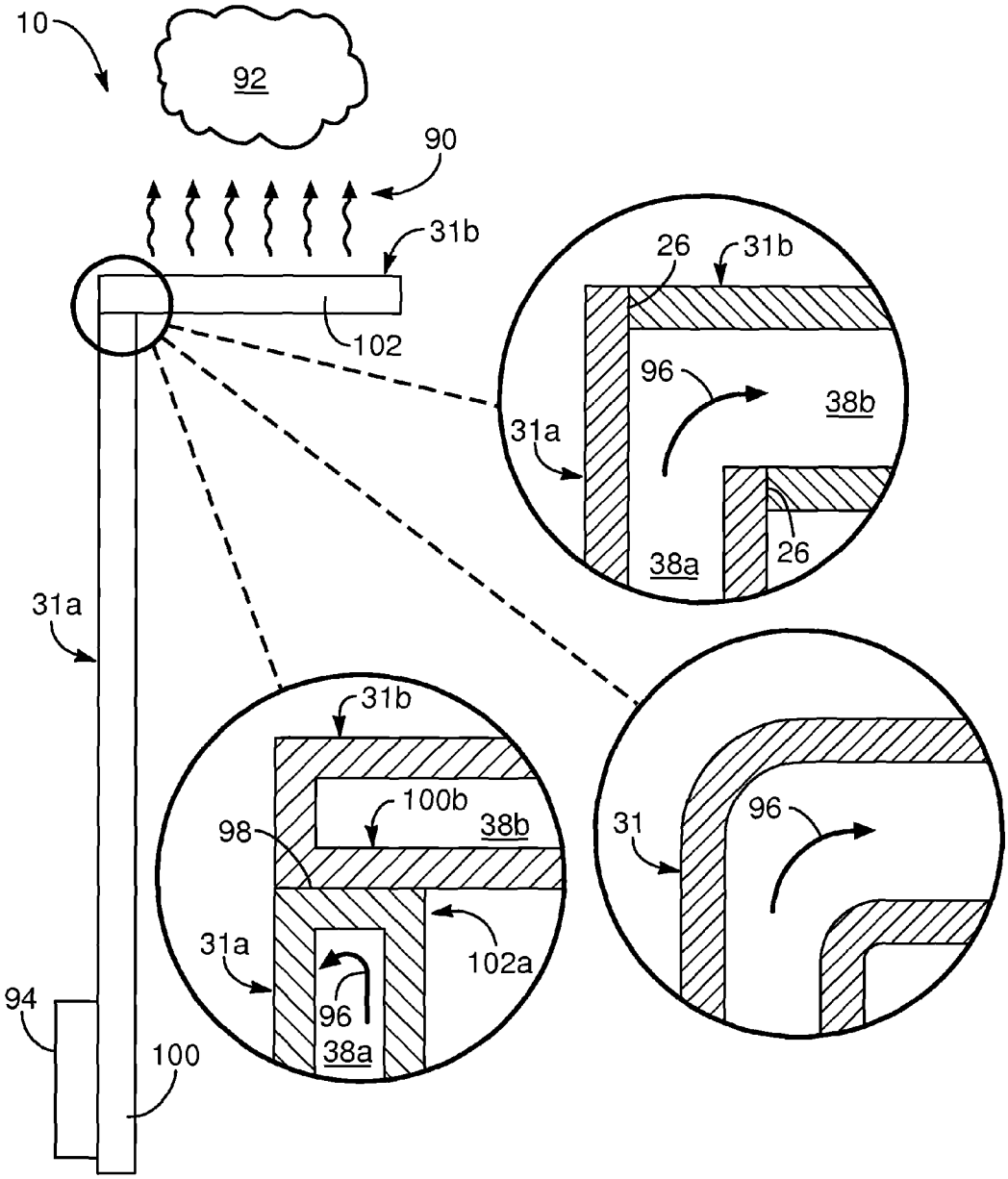
FIG. 8 is an edge elevation view of one embodiment of an assembly in accordance with the invention connected to another similar assembly, by alternative methods of construction in order to provide multi-dimensional flows of fluids and heat between sources and sinks of thermal energy.

Referring to FIG. 8, heat 90 may be rejected to a sink 92 such as a physical object, or the environment generally. In certain embodiments, the heat sink 92 may be the blackness of the universe as seen from a satellite, or a small, aluminum, finned block as seen by a circuit board. Likewise, a computer case may simply see atmospheric air as the heat sink 92. By whichever mode, the sink 92 may receive heat 90 rejected from the assembly 31 of an apparatus 10.

In the embodiment of FIG. 8, multiple assemblies 31*a*, 31*b* may be connected to transfer only heat therebetween, or to transfer both heat and mass therebetween. Typically, a source 94 of heat may be connected thermally to a typical assembly 3 at which the working fluid 40 will be converted from the liquid phase 42 into the vapor phase 44. Path 96 of the vapor 44 may terminate in the assembly 31*a* near the interface 98 or joint 98 with the assembly 31*b*.

Thus, in general, the comparatively hotter region 100 or the boiling region 100 transports the working fluid 40 in the vapor phase 44 along the gap 38*a* or toward the gap 38*a*. The region 102*a*, the vapor phase 44 condenses back to the liquid phase 42. In the alternative embodiment, the comparative cooler region 102 serves as the area of condensation 102 or the comparatively cooler area 102 in the apparatus 10. In such an embodiment, the path 96 of the vapor phase 44 passes from the gap 38*a* into the gap 38*b* to access the cooler region 102 of the assembly 31*b*.

Changing directions, and orientations between vertical and horizontal with respect to gravity can alter the fluid flow characteristics and the associated heat transfer of the apparatus 10. Nevertheless, in many embodiments, a selection of the dimensions, directions, and orientations in accordance with the forces of gravity, the fluid properties, and the heat transfer characteristics of the apparatus 10 as well as the characteristics of the source 100 and sink 92, may result in completely suitable geometries of relative complexity even in earthbound applications.

In microgravity environments, such as in satellites and the like, complex geometries are less problematic since the fluid dynamic forces and thermal effect are not so significantly effected by the gravitational forces. For example, in the illustrated embodiment of FIG. 8, vapor generated in the comparative hotter region 100 of the assembly 31*a* may be expected to ascend to a comparative cooler region 102*a* or the comparative cooler region 102 of the apparatus 10. Likewise, liquids condensed in the comparative cooler region 102*a* or 102 will typically descend back toward the comparatively hotter region 100 to reflood the channels 14 at that location. In low gravity, little or no preference may exist for flows to follow gravity. Thus, flow would be dictated by the locations of heat sinks 92 and sources 94.

Thus, in the apparatus 10 in accordance with the invention, orientation in a gravitational environment may be engineered by the sizing of the channels 14, the viscosity, the surface characteristics of the liquids and solids involved, and the like. Thus, capillaries or channels 14 of sufficiently small size with liquids 42 having the proper surface tension may literally climb the channels 14 of the assembly 31*a* of FIG. 8.

Likewise, such a system may be designed to rely on gravity to augment the thermal and fluid mechanisms rather than operate contrary to the surface tension and capillary effects. Thus, in the embodiment illustrated in FIG. 8 in an earthbound environment, region 100 may best serve as a boiling region for converting the liquid phase 42 into the vapor phase 44, while the region 102 may be considered a condensing region converting the vapor phase 44 back into the liquid phase 42 of the working fluid 40.

Figure 9:
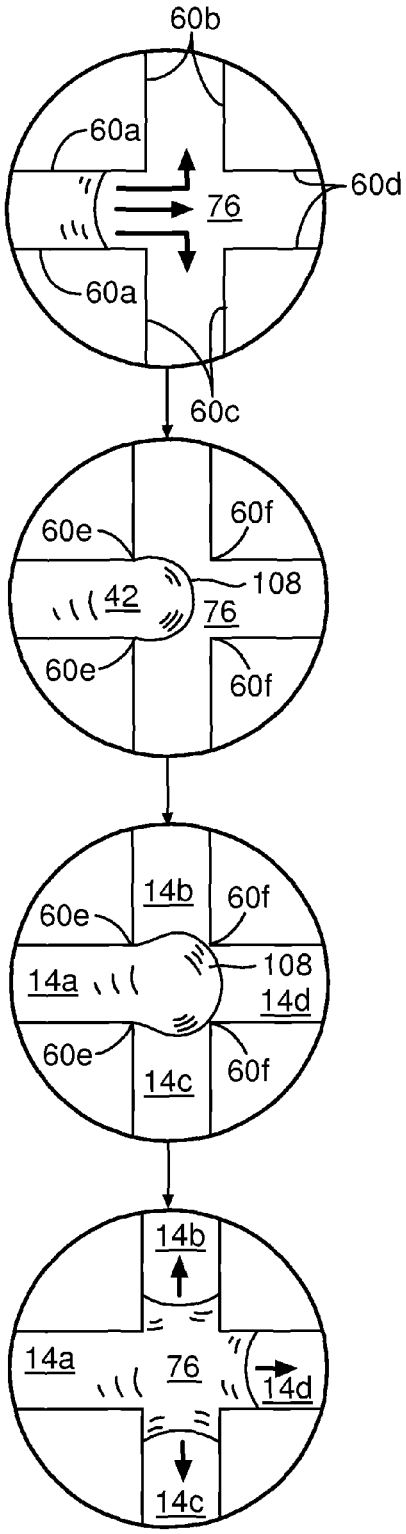
FIG. 9 is a schematic representation of fluid flow at an intersection of channels in one embodiment of an apparatus in accordance with the invention.
Figure 10:
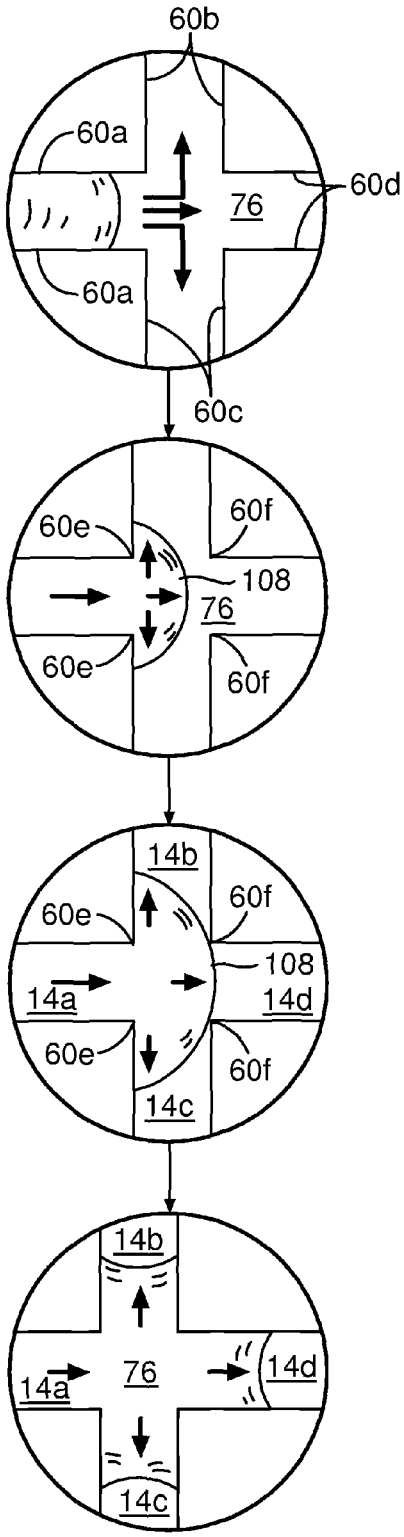
FIG. 10 is a progression of fluid flow through an intersection of channels of an assembly in accordance with the invention operating under a different and favorable capillary or surface tension relationship between the liquid and the solid of the assembly.

Referring to FIGS. 9 and 10, a sequence of flow is illustrated for initial wetting or re-wetting of the dry channels 14 by the liquid phase 42 of the working fluid 40. For example, in FIG. 9, the performance of a liquid 42 having comparatively more surface tension with itself and comparatively less of a surface tension force acting with respect to the channel material 14 is illustrated. By contrast, FIG. 10 illustrates a working fluid 40 as a liquid phase 42 acting in a channel 14 having a comparatively greater surface tension force with the liquid 42 as compared with the liquid-to-liquid forces.

In either event, as the liquid approaches the intersection 76, it has the opportunity to travel in any of the other three directions available at the intersection of 76. The liquid 42 may form a droplet 108, but the droplet 108 must eventually fill the intersection 76, and be broken to adhere to the vertices 60 of the intersection. Thus, in FIG. 9, the liquid 42 travels along the vertices 60*a* of the channel 14, eventually extends beyond the vertical vertices 60*e* at the corners of the pedestal 16, then extends across the channels 14*b*, 14*c* toward the channel 14*d* and the vertices 60*f*. Once the liquid bulb 108 or droplet 108 has adhered to the vertices 60, the liquid travels along the channels 14*b*, 14*c*, 14*d* from the intersection 76, continuing to be fed through the channel 14*a*.

Similarly, in the embodiment of FIG. 10, where surface tension forces tend first to promote wetting along the floor 30 of a channel 14, the liquid 42 may progress along the vertices 60*a* in the channel 14*a*, passing to the intersection 76 wherein the bulb 108 takes on the character more of running along the floor 60 of a channel 14, thus spreading along the floor toward the vertices 60*f* from the vertices 60*e*. Ultimately, the liquid then adheres to the floor traveling along each of the channels 14*b*, 14*c*, 14*d* fed from the channel 14*a* through the intersection 76.

Figure 11:
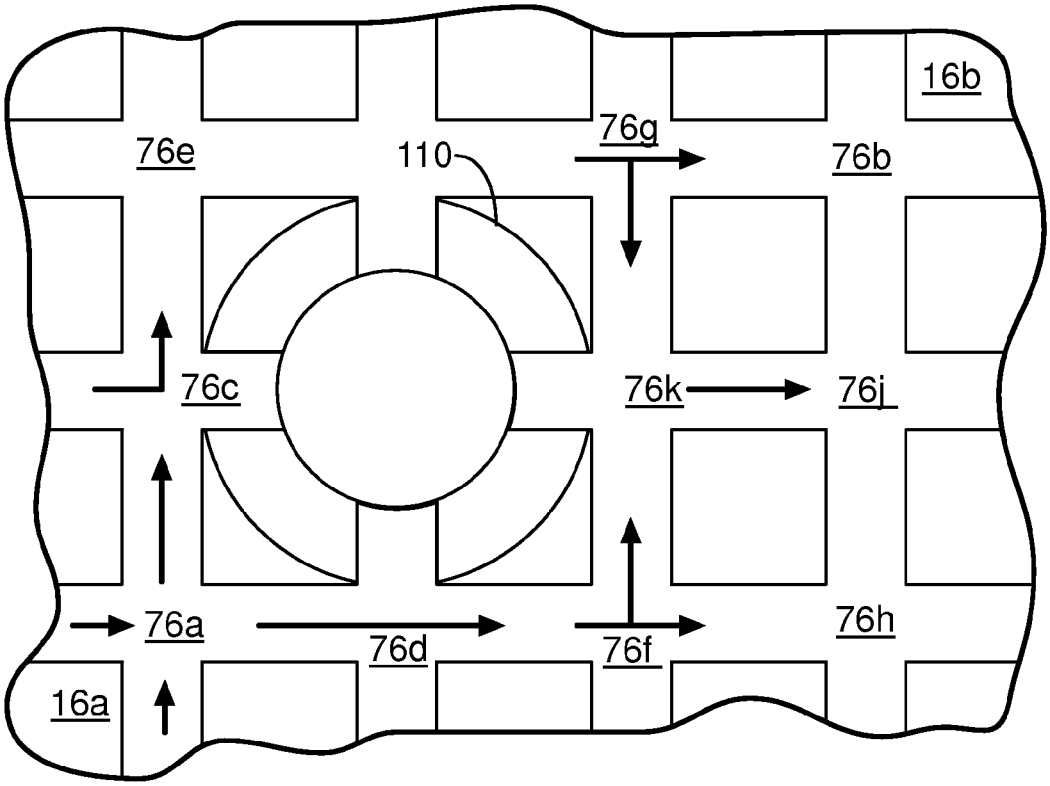
FIG. 11 shows a schematic representation of the choices of flow directions for liquid operating in the channels in accordance with the invention between two locations obstructed from direct access to one another.

Referring to FIG. 11, an obstruction 110 within the matrix of channels 14 may exist for any number of reasons. For example, the obstruction 110 may be a spacer 80. The spacer 80 also may serve as a fastener 80 to connect the base 12 and top 22 together. In the embodiment of FIG. 11, fluid in the region of the pedestal 16*a* cannot pass through the obstruction 110 on its way to the area of the pedestal 16*b*. Accordingly, the flow arriving at the intersection 76*a* may pass toward the intersection 76*c* and 76*e*, or toward the intersections 76*d* and 76*f*.

From either the intersection 76*e* or the intersection 76*f*, the fluid 42 may pass toward the intersections 76*g*, 76*k*, 76*h*, and 76*j* in order to arrive at the intersection 76*b*. Thus, despite obstructions, each intersection 76 tends to be filled promptly from any direction from which working fluid 40 becomes available.

Figure 12:
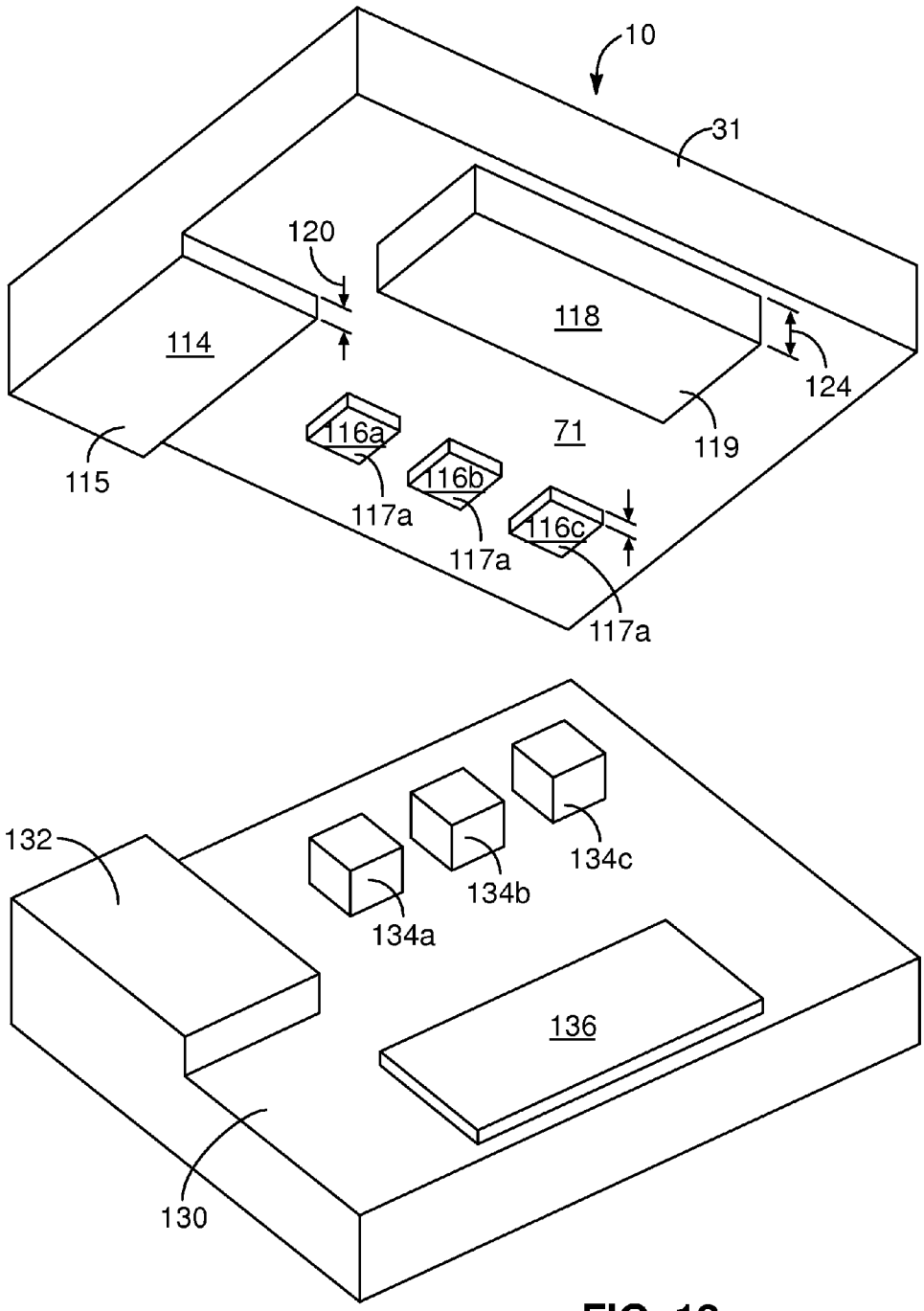
FIG. 12 is a perspective view of one embodiment of an assembly built up to optimize contact with sources of heat on a circuit board in accordance with the invention.

Referring to FIG. 12, an apparatus 10 may include an assembly 31. The extensions 114, 116, 118 of the apparatus 10 may be either solid conducting portions, such as extensions 114, 116, 118 from the base 12, or may actually be entire assemblies 114, 116, 118 just as the assembly 31. A benefit of making the projections 114, 116, 118 as assemblies 31 having all the heat transfer characteristics of the channels 14 and pedestals 16 described hereinabove, is that minimizing temperature drops can still be achieved. By the same token, manufacturing costs may warrant making multiply assemblies 31, 114, 116, 118 to operate with two-phase heat transfer.

On the other hand, the extensions 114, 116, 118 may be solid blocks of a highly conductive material in order to improve thermal contact between the assembly 31, and a cooled object such as a circuit board or the like. In the illustrated embodiment, each of the extensions 114, 116, 118, has a contact surface 115, 117, 119, respectively.

Each of the contact surfaces 115, 117, 119 is spaced away from the bottom surface 71 of the assembly 31*a* distance or height 120, 122, 124, respectively. The heights 120, 122, 124 correspond to the heat sources 132, 134, 136, respectively, on the circuit board 130 or other mechanism or device 130. Actually, any feature 132, 134, 136 may be a source 94 or a sink 92, since the apparatus 10 is indifferent to where sinks 92 and sources 94 are located. Having sinks 92 and sources 94 (and more particularly source and sink locations 115, 117, 119) spaced away from edges of the apparatus 10 helps to promote omnidirectional flow of working fluid 40 to service all such locations. The different heights 120, 122, 124, correspond to the need for each of the extensions 114, 116, 118, respectively, to reach down to contact its corresponding source 132, 134, 136, respectively.

In the embodiment of FIG. 12, the apparatus 10 is configured as a manufacture having an irregular array of contact surfaces 115, 117, 119, 71, for receiving heat. By manufacturing an array of small assemblies 31, generally, such can be used as the overall assembly 31. The assembly 114, the assembly 116, and the assembly 118 may be added on as needed to make thermal contact with any particular device of any particular thickness. By adjusting the edge wall dimensions 24 of each of the assemblies 31, a manufacturer may provide a broad and highly arbitrary arrangement of heat removal capacity adapted to a wide variety of design options for cooled devices 130, such as circuit boards having localized heat sources 132, 134, 136. The extensions 114, 116, 118 may alternatively be solid, conducting blocks.

Figure 13:
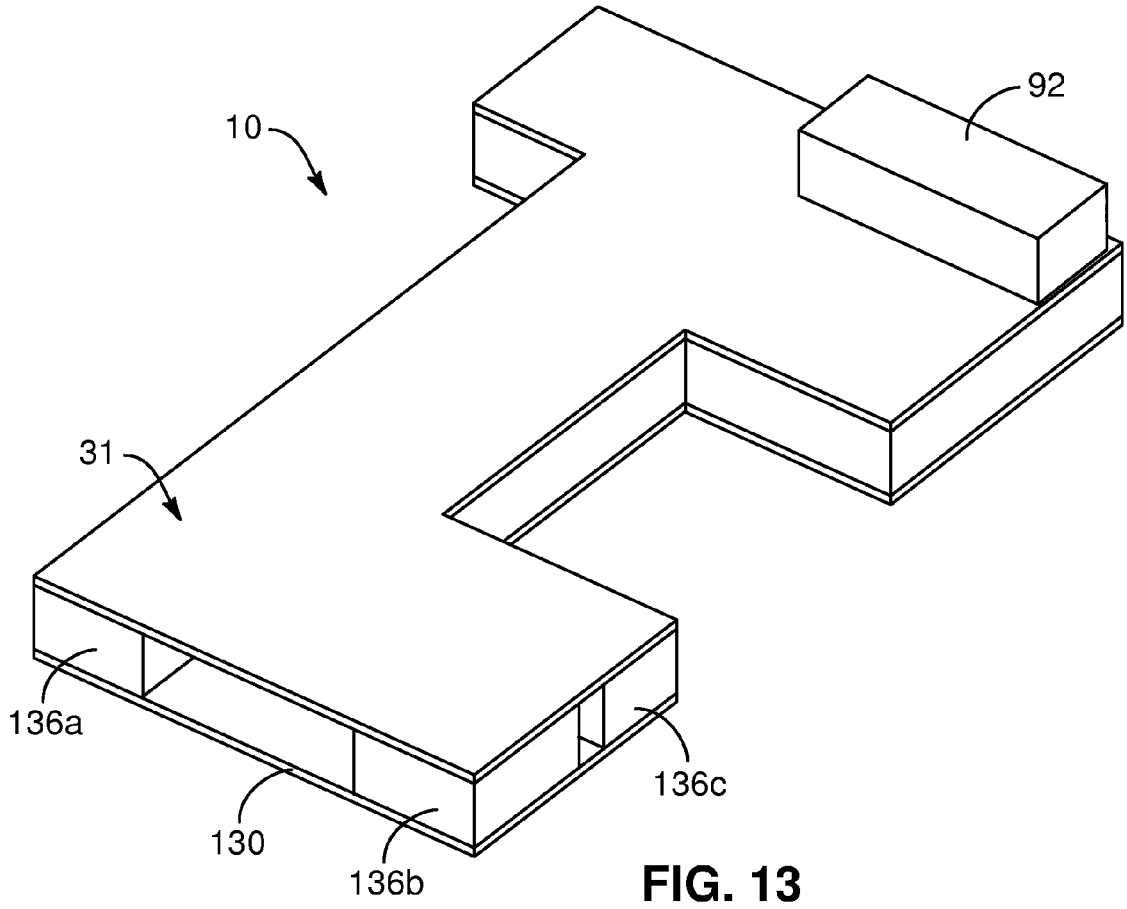
FIG. 13 is a perspective view of one embodiment of an assembly of arbitrary shape in accordance with the invention to accommodate packaging constraints on shape, such as may occur with a circuit board having elements generating heat carried away by the assembly.

Referring to FIG. 13, an apparatus 10 may include an assembly 31 attached to a variety of heat sources 136 mounted on a general device 130. A heat sink 92 may be provided at some selected or arbitrary location on the assembly 31. Meanwhile, the assembly 31 may be configured in substantially any arbitrary shape as required to accommodate other devices around which the apparatus 130 must operate. Manufacturing a planar configuration such as that illustrated in FIG. 13 may be advantageous for certain applications and be particularly easy to manufacture. However, the apparatus 10 and the assembly 31 are not limited to planar configurations. Meanwhile, due to the substantial isotropy of flow at intersections of channels, such arbitrary shapes accommodate other physical requirements in a system.

Figure 14:
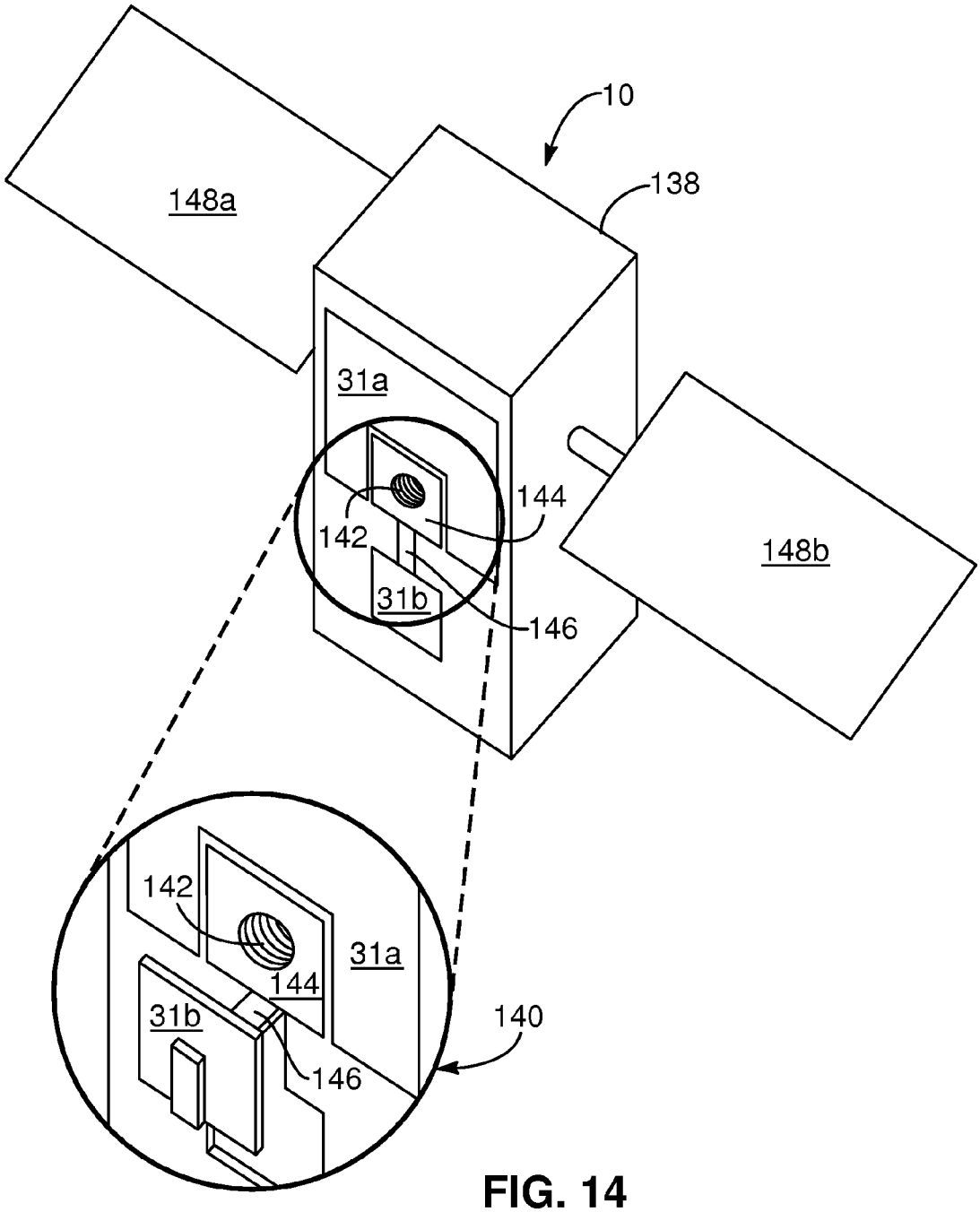
FIG. 14 is a perspective view of one embodiment of an apparatus in accordance with the invention showing a configuration suitable to provide cooling for a satellite, with another embodiment of an assembly in accordance with the invention being used as a calibration target for an optical instrument on the satellite.

Referring to FIG. 14, a satellite 138 may be provided with an assembly 31*a* in accordance with the invention in order to provide generalized cooling by radiant heat transfer. The assembly 31*a* may be constructed in a geometry compatible with the other overall requirements of the satellite 138. The assembly 31*a* may extend into the satellite 138 to contact heat sources 94 in any suitable manner, such as any combination of those embodiments illustrated in FIGS. 8, 12, 13, and 15-17, for example.

Meanwhile, other assemblies 31*b* may be configured to provide desired functionality. For example, the calibration system 140 may be provided to calibrate the optics 142 or the sensors within the optical system 142 of an instrument 144.

A mechanism 146 may secure the assembly 31*b* in a stowed position as illustrated in the satellite 138 in FIG. 14, and may be deployed into an operational or deployed position as illustrated in the inset of FIG. 14. The assembly 31*b* made in accordance with the invention may be positioned by the mechanism 146 in front of or in the view of the optics 142 in order to calibrate the instrument 144 of the satellite 138. Moreover the mechanism 146 may be or include an assembly 31 connecting to, or simply a continuous extension of, the assembly 31*b*, thus providing a flow of working fluid 40 between selected heat sources 94 inside the satellite 138 body and the assembly 31*b* acting as an optical target 31*b*.

One significant advantage of an apparatus 10 in accordance with the invention is that an assembly 31 provided with the two-phase heat transfer mechanism and the channels 14 as described herein above provides a much more uniform temperature of the viewing surface for the optics 142 to view during calibration. The illustrated embodiment shows a comparative smaller assembly 31*b*, but assemblies 31*b* of substantially any suitable size may be formed in order to provide a suitable size, distance, and uniformity of temperature for the calibration system 140.

Figure 15:
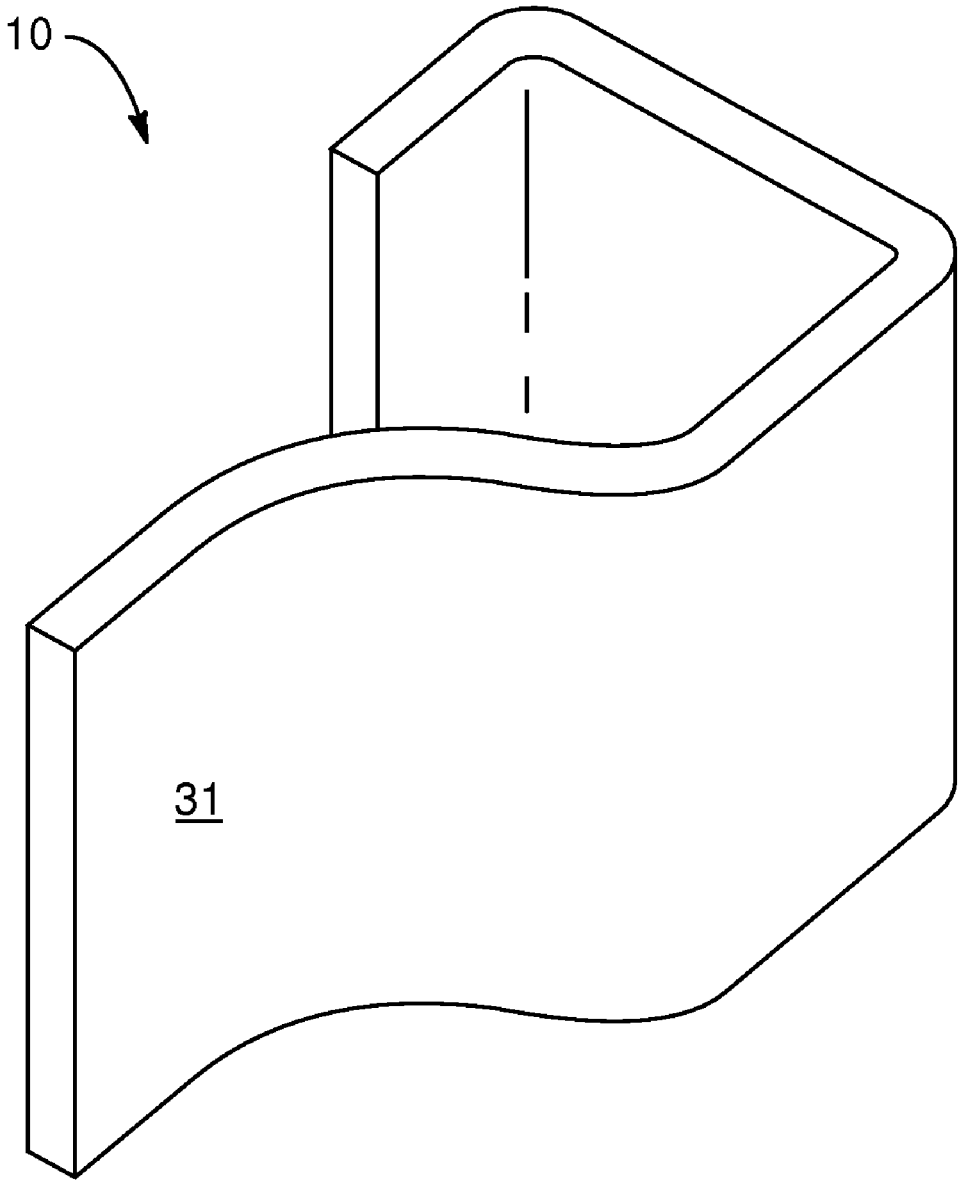
FIG. 15 is a perspective view of one embodiment of a sealed assembly in accordance with the invention having an irregular shape in order to accommodate a more complex geometry than a simple 2-dimensional planar configuration.

Referring to FIG. 15, metals, polymers, and various other composite structures may be formed in a variety of shapes. The shape of FIG. 15 is merely illustrative of the ability to form the assemblies 31 in a wide variety of shapes. The assembly 31 may have either a single base 12 or two bases 12 in the minor-image configuration sealed together and shaped either before or after sealing. The assembly 31 may be formed of a material suitable for the task, whether metal, polymer, composite, or the like.

In the embodiment of FIG. 15, arbitrary geometries dictated by other surrounding environments and equipment may be accommodated by the apparatus 10 in accordance with the invention. Thus, either end or any suitable surface of the apparatus 10 illustrated in FIG. 15 may serve as the contact surface of a heat source, and any other suitable region may be operable as a contact surface for a heat sink. Thus, heat may be transferred from one end to the other, from one extreme to the other, from one side to the other, through the thickness, or from the center to the extremities, or from the extremities to the center for rejection of the heat to a sink or environment.

Figure 16:
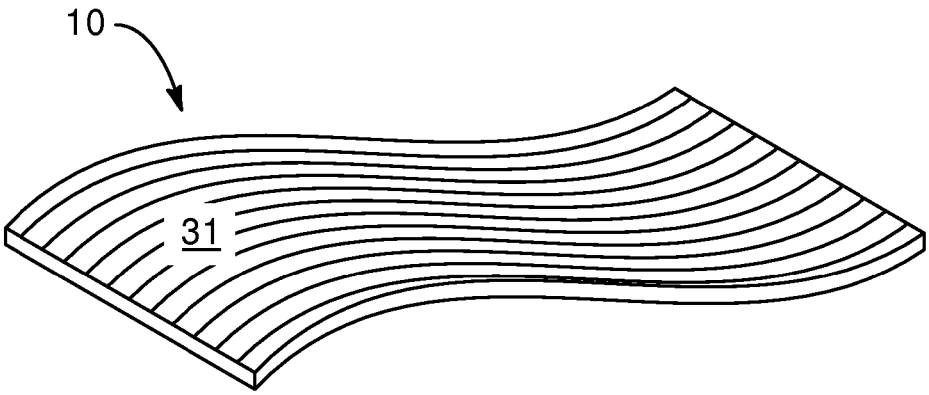
FIG. 16 is an assembly in accordance with the invention formed of a flexible material conformal to variations in height of one or more surfaces that are non-planar, not in a single plane, or both, such as components generating or sinking heat for a mechanism, such as a circuit board.
Figure 17:
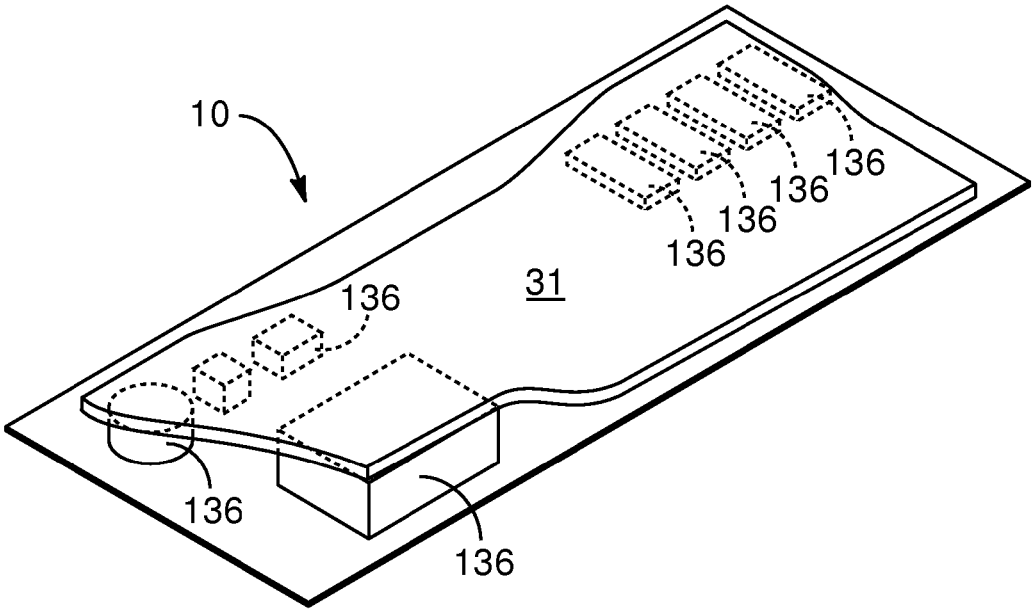
FIG. 17 is a perspective view of the apparatus of FIG. 16 applied to a device, such as a circuit board having sources of heat, having different heights and locations, but capable of making contact with the flexible surface of the assembly.

Referring to FIGS. 16 and 17, the assembly 31 may be formed of any suitable material, including flexible polymers. The characteristic dimensions, the comparative stiffness and the like may be adjusted by selecting and forming composite materials. For example, many flexible materials are available that will bend in flexure. These same materials may or may not bend in any dimension other than their thickness. Thus, they may be comparatively more rigid in shear within the surface. Similarly, other materials may be manufactured to provide substantially isotropic mechanical properties. These may tend to drape and be flexible in one or more dimensions. The flexible assembly 31 of FIG. 17, may be made in accordance with the description hereinabove, and include a base material sufficiently flexible to be draped across a surface or multiple surfaces of various heat sources 136. In the embodiment of FIG. 17, the assembly 31 has been draped to contact each of the heat sources, rejecting heat to another location. No heat sink is illustrated in FIG. 17, as a matter of clarity. However, the assembly 31 may include any type of heat sink described hereinabove, including simply rejecting heat from one its surfaces to the environment.

Figure 18:
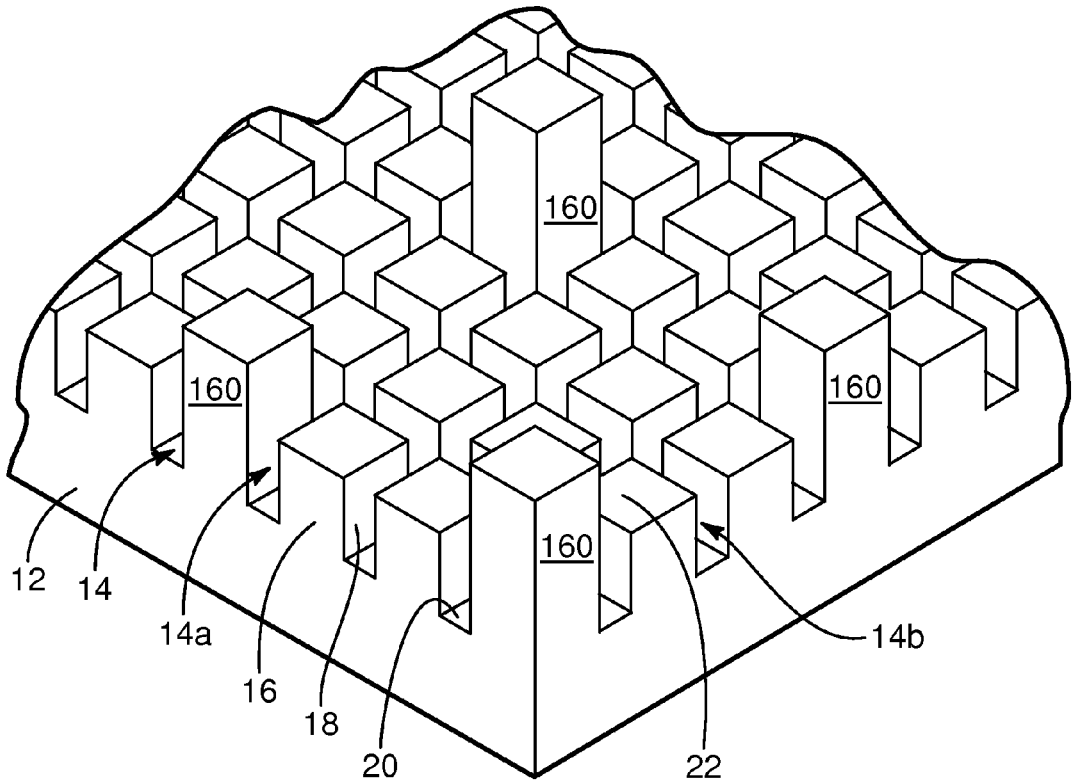
FIG. 18 is one embodiment of an apparatus in accordance with the invention having pedestals forming the walls of channels at non-identical heights, in order to provide embedded stand-offs for either a ceiling plate above the substrate, or a minor-image of the substrate as the ceiling plate, such as may be suitable for the apparatus of FIGS. 1-17.
Figure 18:
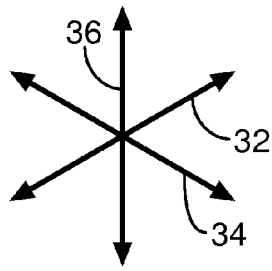

Referring to FIG. 18, in one embodiment of an apparatus and method in accordance with the invention, certain pedestals 160 may be made of different dimensions, such as having greater heights 56 than surrounding pedestals 16. Accordingly, a top 30 or a mirror-image base 12 may be placed on the pedestal 160 in order to provide some standoff distance while minimizing obstructions to the channels 14. Nevertheless, the spacers 80 may also be relied upon to provide standoff distance between the base 12 and top 22 or mirror-image top 12 opposite thereto. The benefit of the overlength pedestals 160 is that the soft or flexible draping apparatus 10 of FIGS. 16-17 may be made of a comparatively weaker or softer material while still maintaining the gap 38 as needed for transport of vapor therethrough.

Figure 19:
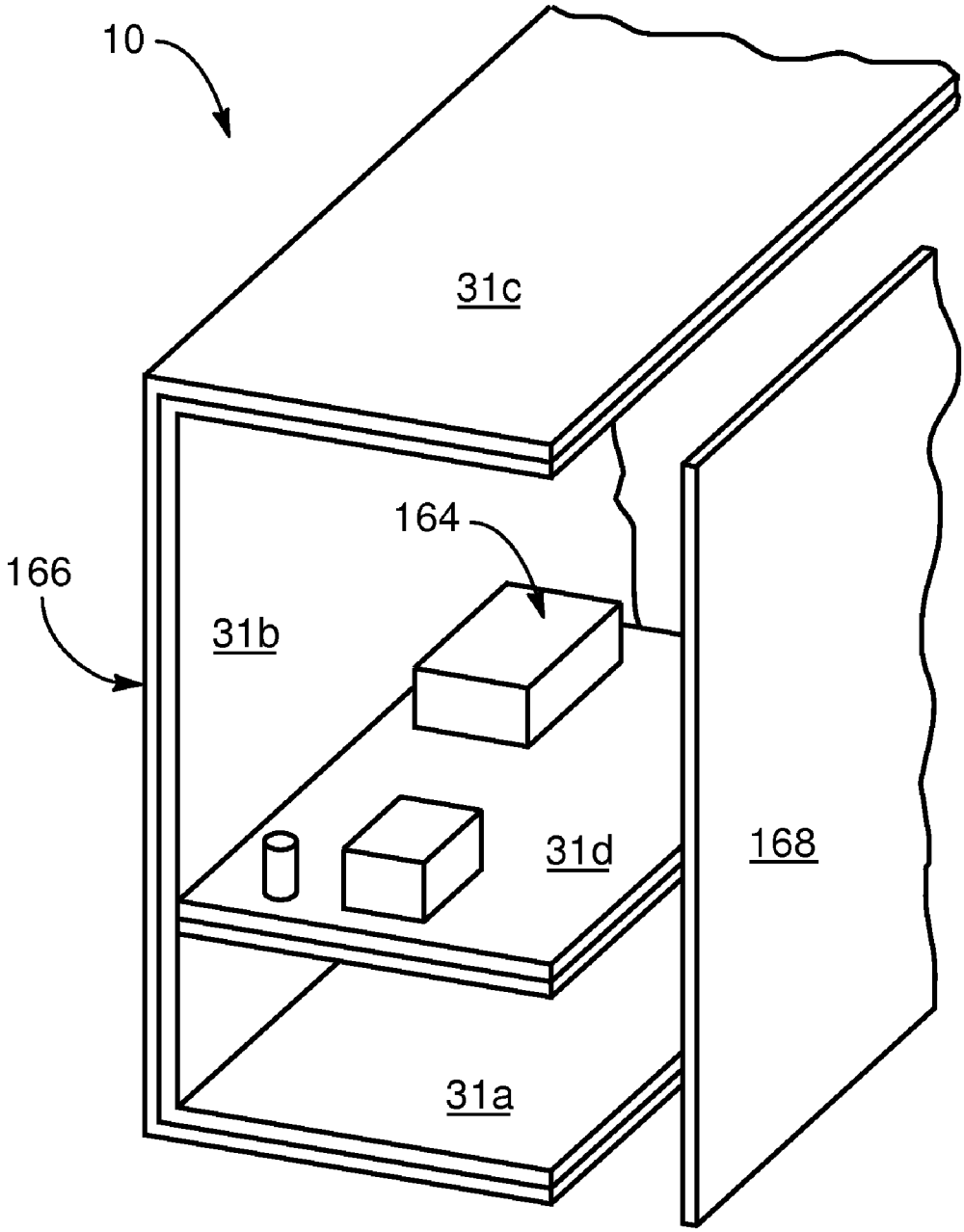
FIG. 19 is an apparatus, formed as a cabinet or case, wherein the walls of the case are thermally active assemblies in accordance with the invention, connected to one another in order to carry heat from sources of heat within the cabinet, to outer walls thereof in order to provide heat distribution from a comparatively concentrated source to a comparatively distributed convective or radiative region.

Referring to FIG. 19, devices 164 may be arranged in a system 130 or source 130, including being arranged on an assembly 31*d* in accordance with the invention. For example, a device 164 may be a power supply or a particular structure generating a substantial thermal load in a system. Accordingly, devices 164 may be mounted above or below an assembly 31*d* in accordance with the invention. The assembly 31*d* may be connected to the assembly 31*b* by any suitable method, including those illustrated in FIG. 8 or elsewhere above. Likewise, the assemblies 31*a*, 31*b*, 31*c* may be formed as a single assembly such as that of FIG. 15, or as a combined assembly of devices as illustrated in FIG. 8. Thus, for example, the case 166 may actually rely on its outer surface as a heat rejection mechanism, in order to provide a substantially larger area than would be available to any particular heat source 64.

Meanwhile, an enclosure 168 may or may not be configured as one of the assemblies 31*d* of an apparatus 10. A computer may be configured as illustrated in FIG. 19 in order to provide the entire surface area of the case at ambient temperature, and a comparatively small thermal differential or temperature differential between large sources of heat 164, and the outer environment surrounding the case 166. Thus, in the absence of other active elements (e.g. fans, heat sinks, and the like), the additional area provided by the overall size of the case 166, as well as the extremely small temperature differentials available in an apparatus 10 in accordance with the invention, may provide sufficiently large temperature differentials, and sufficiently even temperature distributions as to provide free convection heat transfer from the outer surfaces of the case 166 without needing other active elements.

Figure 20:
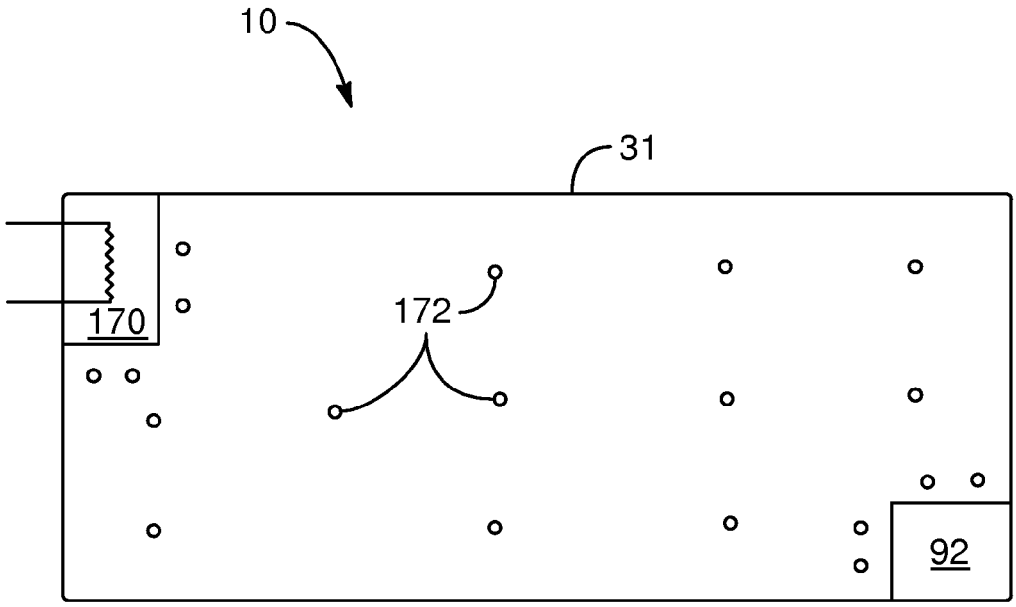
FIG. 20 is a schematic, top, plan view of an experimental test assembly in accordance with the invention.

Referring to FIG. 20, the concepts of the present invention have been persuasively demonstrated in the laboratory. Several test apparatus 10 were fabricated and assembled. A heat source 170 and a heat sink 92 were located in diagonally opposite corners of a rectangular assembly 31. Thermocouples 172 were strategically placed about the outer surface, and the entire system was thermally isolated from the surroundings. With 50 watts of heat input, the measured temperature difference between the heat source and heat sink locations was less than 1° C. and within the precision of the thermocouples. This may be compared with a steady-state conduction temperature difference of 97° C. for the same heat input before the working fluid was installed.

Also relevant to technology applications in space radiator design was a test wherein one side of an assembly 31, similar to that illustrated in FIG. 2 and about one foot wide and 2½ feet long, was painted black, with thermocouples appropriately distributed over the surface. With a strip heater taped to the opposite side of the assembly, this assembly was placed in an enclosure such that the only heat sink capacity was via radiation from the black surface to a cooler enclosure surface. At several levels of heat input, the steady state temperature readings for all thermocouples on the radiating surface were uniform within the accuracy of the temperature measuring system.

A lightweight, rigid, assembly 31 fabricated from a composite material (see FIG. 3) was also tested with the results shown in FIG. 21.

What is claimed and desired to be secured by United States Letters Patent is:

1. An apparatus comprising:

a first surface extending at least in first and second directions mutually orthogonal to one another;

a plurality of second surfaces extending from the first surface to form channels, the first surface forming a bottom surface of each thereof;

a working fluid passing continuously and substantially isotropically by capillary action in the first and second directions among the channels; and the first and second surfaces connecting at vertices, the first and second surfaces and vertices being sized relative to one another to support substantially continuous, isotropic, capillary action along the first surface without a wick;

wherein the working fluid operates in first and second phases to:

receive heat while in the first phase, directly from a first location on the first surface;

transfer the heat while in the second phase along the channels to proximate a second location on the first surface;

deliver heat to the second location while transitioning from the second phase to the first phase; and return by capillary action through the channels, without a wick, to the first location.

2. The apparatus of claim 1, wherein the vertices comprise intersections of the first surface with at least one of the second surfaces and intersections of the at least one of the second surfaces with at least one other second surface of the plurality of second surfaces.

3. The apparatus of claim 1, wherein the channels each further comprise a continuous bottom surface and a discontinuous side surface.

4. The apparatus of claim 3, wherein the channels are formed in equidistant and mutually orthogonal ranks.

5. The apparatus of claim 4, wherein the channels are of substantially identical widths and comparable depths.

6. The apparatus of claim 5, wherein the comparable depths are selected to reduce stripping of the working fluid in the first phase away from the first surface by the working fluid in the second phase passing thereover.

7. The apparatus of claim 6, wherein the comparable depths are substantially identical.

8. The apparatus of claim 7, wherein the first surface extends substantially, exclusively in the plane defined by the first and second directions.

9. The apparatus of claim 1, wherein the vertices comprise segments of curves formed by the intersection of the first and second surfaces.

10. The apparatus of claim 9, wherein the curves are lines, and the segments are line segments.

11. The apparatus of claim 1, wherein each channel has a width corresponding to a distance between two second surfaces, adjacent to one another and both intersecting the first surface.

12. The apparatus of claim 11, wherein:

the vertices are line segments of intersection of the first and second surfaces, separated by gaps in the second surfaces; and the gaps and vertices are sized to effect the substantially isotropic flow by capillary action along the vertices and across the gaps.

13. The apparatus of claim 1, further comprising:

the vertices further comprising curves formed by intersection of the first surface with at least one of the second surfaces and intersection of the at least one of the second surfaces with at least one other second surface of the plurality of second surfaces;

the working fluid, while in the first phase moving along the first surface and the working fluid, while in the second phase, moving along the channels at a distance away from the first surface.

14. The apparatus of claim 1, wherein:

the channels each comprise a continuous bottom surface and a discontinuous side surface;

the channels are formed in equidistant and mutually orthogonal ranks; and the channels are of substantially identical widths and substantially comparable depths, each selected to reduce stripping of the working fluid in a first phase thereof away from the first surface by the working fluid in a second phase thereof passing there over.

15. The apparatus of claim 1, wherein the channels have a width varying with distance from the first surface.

16. The apparatus of claim 1, wherein the channels have a width that decreases with distance from the first surface.

17. An apparatus comprising:

a substrate formed to have a first surface extending in at least first and second directions, and a second surface spaced therefrom in a third direction;

a working fluid in contact with the second surface and selected to operate in two phases within the apparatus, convening at least a portion of a liquid phase thereof into a vapor phase in proximate a heat source and converting at least a portion of the vapor phase thereof into the liquid phase proximate a heat sink;

the substrate formed to have first channels each having a corresponding first width, a first depth, and a first length extending in the first direction, the first channels extending substantially parallel to one another substantially continuously in a first direction along the second surface;

the substrate formed to have second channels each having a second width, a second depth, and a second length extending substantially parallel to one another substantially continuously in the second direction along the second surface to intersect the first channels; and the first and second widths and first and second depths selected to provide flow of the working fluid through the first and second channels substantially isotropically with respect to the first and second directions;

wherein the first and second depths are selected to reduce stripping of the working fluid in the liquid phase away from the first and second channels by the working fluid in the vapor phase passing thereover.

18. The apparatus of claim 17, wherein the first surface is in thermal contact with a heat source effective to condense a portion of the working fluid from the vapor phase to the liquid phase.

19. The apparatus of claim 17, wherein the working fluid is in thermal contact with a heat sink effective to condense a portion of the working fluid from a vapor phase to a liquid phase.

20. The apparatus of claim 17, wherein the second surface is spaced from the first surface at least two distances, a bottom thickness corresponding to a minimum distance of the second surface from the first surface and a top thickness corresponding to a maximum distance of the second surface from the first surface.

21. The apparatus of claim 20, wherein the bottom thickness is less than one fourth the difference between the top and bottom thicknesses.

22. The apparatus of claim 20, wherein the channels have a tapered portion having a wide end thereof closest the first surface.

23. The apparatus of claim 17, further comprising a channel wall enclosing at least one first channel, and wherein the second surface is spaced from the first surface by a bottom thickness corresponding to the minimum distance of the at least one first channel from the first surface, and a top thickness corresponding to the maximum distance of the channel wall from the first surface.

24. The apparatus of claim 17, wherein the geometry thereof is characterized by at least one of:

at least two of the first widths being equal to each other;

the first widths being substantially all equal to each other;

at least two of the first depths being equal to each other;

the first depths being substantially all equal to each other;

at least two of the first lengths being equal to each other; and substantially all of the first lengths being substantially equal to each other.

25. An apparatus comprising:

upper and lower substrates each extending in first and second directions mutually orthogonal to one another and spaced apart from one another in a third direction orthogonal to the first and second directions, the upper and lower substrates each comprising a first surface extending at least in the first and second directions;

a plurality of second surfaces extending from the first surface to form intersecting channels, the first surface forming a bottom surface of each thereof;

a plurality of third surfaces positioned between the channels;

a working fluid passing continuously and substantially isotropically by capillary action in the first and second directions among the channels, the working fluid having a first phase and a liquid phase, the channels having a depth effective to reduce stripping of the working fluid in the first phase away from the first surface by the working fluid in the second phase passing thereover; and the first and second surfaces connecting at vertices, the first and second surfaces and vertices being sized relative to one another to support substantially continuous, isotropic, capillary action along the first surface without a wick.

26. The apparatus of claim 25, wherein a distance between the third surfaces of the first substrate and the third surfaces of the second substrate is between 1 and 4 times the depth of the channels.

* * * * *